US007857927B2

(12) United States Patent
Guilhem et al.

(10) Patent No.: US 7,857,927 B2
(45) **Date of Patent: *Dec. 28, 2010**

(54) METHOD AND MACHINE FOR PRODUCING A SEAM WHICH IS NOT SUSCEPTIBLE TO COMING UNDONE

(76) Inventors: Christian Guilhem, Route Nationale 20, Albias (FR) 82350; Jacques Guilhem, Route National 20, Albias (FR) 82350; Marc Guilhem, Route Nationale 20, Albias (FR) 82350

( * ) Notice: Subject to any disclaimer, the term of this patent is extended or adjusted under 35 U.S.C. 154(b) by 1001 days.

This patent is subject to a terminal disclaimer.

(21) Appl. No.: 11/700,769

(22) Filed: Feb. 1, 2007

(65) Prior Publication Data

US 2007/0131337 A1 Jun. 14, 2007

Related U.S. Application Data

(62) Division of application No. 10/446,660, filed on May 29, 2003, now Pat. No. 7,291,236.

(60) Provisional application No. 60/407,953, filed on Sep. 5, 2002.

(30) Foreign Application Priority Data

May 29, 2002 (FR) ..... 02 06558

(51) Int. Cl.

| | |
|---|---|
| ***B32B 3/06*** | (2006.01) |
| ***B32B 9/00*** | (2006.01) |
| ***D03D 47/50*** | (2006.01) |
| ***D05B 1/00*** | (2006.01) |

(52) U.S. Cl. ..... 156/93; 156/88; 428/104; 112/475

(58) Field of Classification Search ..... 156/88, 156/93; 428/104; 112/475
See application file for complete search history.

(56) References Cited

U.S. PATENT DOCUMENTS

| | | | |
|---|---|---|---|
| 1,560,712 | A | 11/1925 | Naylor |
| 3,041,816 | A | 7/1962 | Stuewer |
| 3,296,990 | A | 1/1967 | Simjian |
| 5,003,902 | A | 4/1991 | Benstock et al. |
| 5,856,243 | A | 1/1999 | Geirhos et al. |

FOREIGN PATENT DOCUMENTS

| | | |
|---|---|---|
| EP | 0 223 312 | 9/1990 |
| FR | 866.765 | 10/1943 |
| FR | 4.427.611 | 1/1966 |
| FR | 90.562 | 1/1968 |
| JP | 09084980 | 3/1997 |
| WO | WO 99/52710 | 10/1999 |

*Primary Examiner*—Justin Fischer
(74) *Attorney, Agent, or Firm*—Young & Thompson

(57) ABSTRACT

The invention relates to a method and a machine for producing a seam (12) which is not susceptible to coming undone, with at least one interlooped and/or interlaced stitching thread and with stitching passes in or through at least one thickness of the material of an object, called the sewn object (3). The seam (12) is produced with at least one stitching thread having a thermoplastic material at least on its exterior. At least one infrared laser beam (17, 18) is applied locally to the seam (12) on the exterior of the sewn object (3), which laser beam is adapted to soften punctually the thermoplastic material present on the exterior of at least one strand of thread extending on the exterior of the sewn object (3) and adjacent to at least one other strand of thread. An air jet enables mingling of the softened fibers and at least one pressing device (6) is then applied to the softened and mingled thermoplastic material of at least one strand of thread of so as to join punctually the adjacent strands together.

16 Claims, 14 Drawing Sheets

METHOD AND MACHINE FOR PRODUCING A SEAM WHICH IS NOT SUSCEPTIBLE TO COMING UNDONE

This application is a division of U.S. application Ser. No. 10/446,660, filed May 29, 2003, now U.S. Pat. No. 7,291,236, which claims priority from French Application 0206558 filed on May 29, 2002 and U.S. provisional application No. 60/407,953 filed on Sep. 5, 2002.

The invention relates to a method and a machine for producing a seam which is not susceptible to coming undone, with interlooped and/or interlaced stitching threads and with stitching passes in or through at least one thickness of the material of an object, called the sewn object, which receives the seam.

Sewing techniques and machines are very diverse, well-known and well-documented. In particular, they are the subject of standards.

Stitches may be decorative and/or functional. For example, they may serve to assemble different pieces to form a sewn object. The materials making up the object may be woven textiles, knitted goods, leathers, synthetic materials, etc. EP-0223312 illustrates an example in which an overedge stitch is used to retain a tensioning thread sliding within a border of a furniture cover. In the case of a seam comprising one or more lines of stitching, the sewn object is drawn continuously across a stitching station of a machine. In other cases, e.g. when sewing on buttons, the sewn object is placed on the stitching station where it remains substantially immobile during the stitching operation. In all cases, to obtain the sewn object, the piece(s) forming it are placed on a stitching station of a sewing machine.

One of the well-known problems posed by the use of a seam is its relative fragility, in that rupture of the initial or final anchorage of the threads, or rupture of one of the stitching threads, is liable to be propagated throughout the seam spontaneously and/or by simple traction on one of the stitching threads and/or by separation of the pieces assembled by the seam. The expression "the seam is susceptible to coming undone" refers to this phenomenon, which may also be called "unravelling". Such is the case, in particular, with stitches formed by interlooped threads or groups of threads such as chain stitches, overedge stitches or cover stitches in which the non-interlaced threads are not knotted to one another.

However, stitches formed by interlooped threads have the advantage of permitting very rapid stitching and, above all, of not requiring a bobbin of limited capacity. For this reason it is preferred in industry to use chain stitches, overedge stitches or cover stitches produced with machines which can be fed by large-capacity thread bobbins and operate very rapidly, while offering wide variations of product and permitting, in particular, the use of a large number (which may be as many as nine) of distinct stitching threads. However, the use of this type of stitch is severely limited by the fact that the stitches form seams which are liable to come undone very easily and can be unravelled in a harmful and undesirable manner. For this reason this type of stitch is not used for assembling pieces under tension which must be guaranteed by the manufacturer—for example, in producing trimming covers for chairs.

With stitches formed by interlaced threads or groups of threads this problem is posed less acutely but still exists in that a rupture in the seam can be spontaneously propagated in an undesirable and harmful manner. In short, the seam is liable to come undone even if the unravelling is less rapid than in the case of interlooped stitches.

In some specific applications such as those of producing impermeable seams it has been proposed to reinforce a seam by an assembly using supplementary welding and/or bonding, which also indirectly has the result of mitigating the problem of unravelling.

For example, FR-90562, U.S. Pat. Nos. 1,560,712, 5,003,902 describe impermeable seams combining one or more seams and a strip of thermoplastic material serving to weld together the assembled pieces of fabric and/or the seam(s). However, these methods are costly in material, labour and manufacturing time. Moreover, they are limited in application to pieces to be assembled by partial overlap. They are not applicable, for example, to an edge seam or to sewing on buttons. In addition, the characteristics of the seam regarding flexibility and appearance are greatly modified by the weld formed by the thermoplastic strip. In particular, the use of an interposed thermoplastic strip increases the thickness of the sewn object.

It has also been considered (FR-886765, U.S. Pat. No. 3,296,990) to utilise the thermoplastic material which forms the pieces receiving the seam to weld the threads of the seam to this material by local application of heat, with the aid of a welding device by point contact or by ultrasound, in the places where the stitching thread penetrates the material. These methods are limited in application to the assembly of pieces made of thermoplastic material. Furthermore, they give rise to changes of flexibility and appearance. In addition, these methods necessarily join the stitching threads to the sewn object, which sometimes is not desired, for example in the case of EP-0223312, where a sliding tensioning thread is interposed between the stitching threads and the sewn object. Moreover, these methods are not utilised in practice, in particular because the precise realisation of the weld specifically at the exact points where the thread penetrates the material is extremely difficult, if not impossible, to achieve in practice. With ultrasound, only a total fusion of the thread and a portion of the material of the piece along a continuous line of fusion can actually be achieved. For this reason the production of the seam itself loses much of its interest, the thread being finally fused with the material of the piece. Furthermore, FR-886765, which dates from 1942, does not specify how point-welding can be realised in practice.

FR-1427611 describes a method for treating fabrics (woven goods, knitted goods, etc.) which aims to avoid the sliding or "slippage" of interlaced threads of a fabric, this term referring in this document to the phenomenon of the unravelling of threads of a fabric after the catching or breaking of a thread in the fabric. As explained in that document, it had been proposed to solve this problem by applying an adhesive substance which, however, stiffens the fabric. It had also been proposed to treat textiles such as nylon stockings made of thermoplastic threads by using a local application of heat, which in practice is extremely difficult to control, so that the textile can either be damaged by excessive heat (complete melting of threads), or not be treated effectively if the heat is insufficient to fix the threads of the textile. In all cases, the appearance of the textile and its strength are degraded. It is therefore advocated in that patent to apply spaced drops of an adhesive solution to only some intersections of threads in the textile. This method necessitates a specific treatment stage for the textile after manufacture. This document does not envisage the application of the method to a seam. At all events, it would be extremely difficult and expensive to apply this method to a seam rather than to a textile.

JP-09084980, in a variant, envisages solving the problem of the unravelling of a thread of a chain stitch by using an adhesive thermoplastic thread (polynosic, acrylic, vinylon, etc.) and heating and melting the chain stitches using a laser beam or other heating device arranged below the work-carrying plate downstream of the pressing foot in order to weld the chains stitches. However, as mentioned above with reference to FR-1427611, it is not possible to implement such a method. Indeed, it is impossible in practice to apply the precise quantity of heat, which varies according to the thread used and the material of the piece sewn (more or less absorbent and/or reflective), in order to obtain a strictly partial fusion and a welding of stitches. Furthermore, the stitching thread contracts, carbonises and loses its mechanical strength after fusing. In addition, the strands of melted thread then immediately come into contact with the work-carrying plate to which they adhere or on which they deposit melted matter. The result, in the best case, is almost immediate blocking of the aperture for the laser beam and even sticking of the sewn object, which no longer slides on the plate. This variant described in JP-09084980 cannot, therefore, be successfully implemented in industrial practice.

In this context it is the object of the invention to propose a method and a machine permitting the realisation of a seam which is not susceptible to coming undone, in a simple, rapid and economical manner which is compatible with the constraints of operation on an industrial scale, without harming the mechanical properties of the sewn object and while at least substantially preserving the mechanical properties of the seam itself.

More particularly, it is also an object of the invention to propose such a method and such a machine with which the appearance of the sewn object and of the seam can be at least substantially preserved, and in particular can present a traditional and aesthetically-pleasing appearance of the seam.

In particular, it is an object of the invention to permit the realisation of such a seam the stiffness of which is not increased by the treatment aiming to prevent the seam from coming undone. Such stiffness or rigidity (in bending or in compression) can, in particular, form an obstacle to use, for example in the case of pieces of fabric in contact with the skin such as clothing or undergarments.

In particular, it is an object of the invention to permit the realisation of a seam capable of being subjected to high stresses. More particularly, it is an object of the invention to allow the realisation of a seam which is not susceptible to coming undone but in which the stitching threads are able not to be joined integrally to the material forming the sewn object. It is also an object of the invention to permit the realisation of such a seam in various applications, at various locations on the sewn object (including the edge) and regardless of the material making up the object. It is an object of the invention, for example, to permit the realisation of an overedge stitch which is not susceptible to coming undone and which forms a passage to receive a sliding tensioning thread, or to permit the sewing on of buttons with a stitch which is not susceptible to coming undone.

It is in particular an object of the invention to propose a method which can be implemented without handling, in a single stage, in particular by the stitching station, and/or simultaneously with the stage of producing the seam, and without necessitating prolonged and/or complicated adjustments before each seam.

To achieve this, the invention relates to a method for producing a seam which is not susceptible to coming undone, with at least one interlooped and/or interlaced thread and with stitching passes in or through at least one thickness of material of an object, called the sewn object, which receives the seam, this seam comprising at least one strand of sewn stitching thread extending on the exterior of the sewn object and adjacent to at least one other strand of sewn stitching thread on the exterior of the sewn object, in which:

the seam is produced with at least one stitching thread having a thermoplastic material present at least on the exterior of the stitching thread;

at least one laser beam is then applied locally to the seam on the exterior of at least one strand of sewn stitching thread extending on the exterior of the sewn object and adjacent to at least one other strand of stitching thread on the exterior of the sewn object, wherein:

each laser beam is adapted to soften punctually the thermoplastic material present on the exterior of at least one strand of sewn stitching thread extending on the exterior of the sewn object and adjacent to at least one other strand of sewn stitching thread on the exterior of the sewn object, after the application of each laser beam and before the complete re-solidification of the softened thermoplastic material at least one pressing device is applied to the softened thermoplastic material of at least one strand of stitching thread on which such thermoplastic material is exposed to said laser beam, in such a way as to join punctually all or some of the adjacent strands together on the exterior of the sewn object, by means of said thermoplastic material.

Throughout this document the phrase "a laser beam is applied locally to the seam" and its derivatives mean that said laser beam is oriented towards the seam in such a way that it is projected towards said seam and forms a localised point of impact of the laser beam on the seam.

Advantageously, according to the invention at least one laser beam adapted to soften the thermoplastic material without melting it is applied while raising said thermoplastic material locally to a temperature equal to or above its softening temperature but below its melting point, in particular to a temperature of 3° C. to 15° C. above the softening temperature. In this way, said thermoplastic material does not melt (it does not reach its melting point) and does not become liquefied. It retains its shape at least substantially, and the strands of thread retain their cohesion and their mechanical strength.

In addition, according to the invention at least one jet of pressurised air is advantageously applied to the strands of stitching thread after the application of each laser beam and before the application of a pressing device. The effect of such an air jet is to disperse the fibres forming each thread and/or to displace the adjacent strands with respect to one another. In addition, it allows excessive heating of some parts of the machine to be avoided. Finally, it removes dust or residues of material, in particular in the vicinity of the point of impact of the laser beam and/or in the vicinity of the pressing device. According to the invention an air jet having a width of the order of the diameter of the finest stitching thread which carries thermoplastic material, or smaller than this diameter, is advantageously used. This small cross-section of the air jet has the effect of increasing its efficiency in dispersing the thread fibres while not causing premature or excessive cooling of the thermoplastic material, which remains softened before the application of the pressing device. If necessary, the air of the air jet may be heated.

Advantageously, according to the invention at least one stitching thread formed by at least one thermoplastic material is used and at least one laser beam is used which is so adapted that at least a part of the thickness of each strand of said stitching thread of thermoplastic material softened by said laser beam remains in the non-softened state along its full length.

More generally, according to the invention at least one laser beam is advantageously applied in such a way as to soften only a part of the thickness of each strand of the stitching thread to which it is applied. In this way the seam remains functional, at least a part of the thickness of each strand being left in the non-softened state.

Each pressing device comes into contact with the thermoplastic material through relative displacement and exerts a degree of pressure against this softened material, the sewn object being held opposite said pressing device by a work-carrying plate and/or another pressing device. According to the invention each pressing device advantageously has an irregular (non-smooth) contact surface with the thermoplastic material, so as not to impart to it a deformation visible as a whole (not to flatten it). This contact surface advantageously has teeth, claws, points, notches, serrations, etc., able to penetrate the softened thermoplastic material to bring about individual micro-displacements, causing a final integration of the strands among themselves (without fusion or welding of the whole). Moreover, each pressing device does not slide while in contact with the strands of thread and with the thermoplastic material but accompanies any movement resulting from the stitching. No component of relative motion therefore exists between the pressing device and the thermoplastic material in the stitching direction, i.e. parallel to the exterior face of the object to be sewn.

In addition, according to the invention the seam is advantageously produced by passing the sewn object over a stitching station of a sewing machine, and, during one and the same passage of the sewn object over this stitching station, at least one laser beam is applied after each stitch has been produced, and then at least one pressing device is applied to the softened thermoplastic material. In this way, during the same passage over the stitching station, the stitching and the integration of adjacent strands preventing subsequent unravelling of the seam are produced. The invention therefore in no way modifies the duration of the production of the seam as compared to that of a conventional seam. From the industrial point of view it therefore entails no additional production cost, nor, moreover, does it prevent a back stitch from being produced at the end of the seam.

The term "passage" of the sewn object refers globally to a simple placing and holding of different pieces to be assembled by the seam. For example, it might involve a stitching station for sewing buttons to a garment. This term also includes the act of continuously drawing at least one piece to be sewn, forming the sewn object, across the stitching station, as in the case of sewing machines which produce a seam along at least one stitching line.

According to the invention a pressing device is advantageously applied immediately after the application of a laser beam—in particular directly downstream of this application in the case of a seam having at least one stitching line. In any case, each pressing device should be applied to the thermoplastic material while the latter is still at least partially softened.

According to the invention the stitching station advantageously comprises:

stitching means comprising at least one stitching needle, at least one pair of transporting devices between which parts of the seam and of the sewn object are pressed and pinched and which are able to transport the sewn object across the stitching station in a direction called the stitching direction as the seam is formed, these transporting devices being situated at least in part directly downstream of the stitching means. According to the invention at least one laser beam is applied directly downstream of the stitching means to at least a part of the seam which is to be pinched and transported by the transporting devices, and directly upstream of at least a part of the transporting devices which, while the seam is pinched, performs the function of the pressing device or devices applied to the softened thermoplastic material of at least one strand of the thread of the seam. According to the invention at least one laser beam is advantageously applied directly upstream of a transporting gripper of the stitching station which performs the function of the pressing device on the softened thermoplastic material.

According to the invention at least one air jet is advantageously applied downstream of at least one laser beam and directly upstream of at least a corresponding part of the transporting devices acting as the pressing device or devices.

As a variant, the pressing device may be a rotary transporting device (small wheel, roller, sphere, etc.) which is serrated or corrugated. This may also be a part or a downstream extension of a moving pressure foot for transporting at least a piece of the sewn object and having a preferably serrated or corrugated contact surface.

According to the invention, the seam is advantageously produced with at least one floss and/or bulked stitching thread. Floss and/or bulked threads are well-known and have visibly distinct fibres. In particular, at least one floss and/or bulked thread including fibres of thermoplastic material is used. As a result, the application of the laser beam can be adapted to soften some of the superficial fibres of the thread and the pressing device, particularly if it is formed by a gripper, has the effect of spreading the thermoplastic material softened in this way across the other fibres of the same thread and those of the thread forming an adjacent strand. This produces a practically invisible relative integration which does not flatten the fabric but is nevertheless strong. The use of an air jet is particularly advantageous in the case of such floss threads and/or bulked threads because it promotes the multiplication of points of contact and links between adjacent fibres which are joined without significant modification of the appearance and mechanical properties of the seam.

Thus, the function of the pressing device in the invention is to mix the softened thermoplastic material with the fibres of the adjacent strands. It is applied with pressure in order to crush, or at any rate to bring the adjacent strands into contact with the thermoplastic material softened by the laser.

In addition, according to the invention the seam is advantageously produced using a stitch having threads which are interlooped, not interlaced. For example, a seam is produced using a stitch selected from a chain stitch, an overedge stitch and a cover stitch. This stitch may be produced using one or more stitching threads. The invention is also applicable using a stitch having interlaced threads such as a lock stitch. In all cases the seam must be produced in such a way as to form adjacent strands (parallel or interlacing) on at least one side of the exterior of the sewn object. For example, in the case of a lock stitch having two threads the tension of each thread is preferably regulated during the production of the seam in such a way that the interlacing emerges on the exterior of the sewn object and is not imprisoned within the thickness of the material of this sewn object.

The invention extends to include a machine for implementing a method according to the invention. The invention therefore relates to a machine for producing a seam which is not susceptible to coming undone, having at least one interlooped and/or interlaced stitching thread and with stitching passes in or across at least one thickness of material of an object, called the sewn object, which receives the seam, the seam being produced by passing this sewn object over a stitching station of the machine, which stitching station includes stitching means which include at least one stitching needle and are adapted to form at least one strand of sewn stitching thread which extends on the outside of the sewn object adjacently to at least one other strand of sewn stitching thread on the exterior of the sewn object, said machine including at least one laser source adapted to be able to apply at least one laser beam to the exterior of at least one strand of stitching thread extending on the exterior of the sewn object adjacent to at least one other strand of sewn stitching thread on the exterior of the sewn object, wherein:

at least one laser source is adapted to be able to apply locally to the seam at least one laser beam which is adapted to soften punctually the thermoplastic material present on the exterior of at least one strand of stitching thread extending on the exterior of the sewn object adjacent to at least one other strand of sewn stitching thread on the exterior of the sewn object;

it includes at least one pressing device adapted to be applied to the softened thermoplastic material of at least one strand of stitching thread after the application of each laser beam and before the complete re-solidification of the softened thermoplastic material, in such a way as to join punctually all or some of the adjacent strands together on the exterior of the sewn object by means of said thermoplastic material.

Advantageously, according to the invention each laser source is a laser diode having a wavelength of between 780 nm and 940 nm and a maximum power of 60 W, forming a laser beam less than 1 mm—in particular of the order of 800 μm—in diameter. Advantageously, according to the invention each laser source includes means for controlling the power of the laser beam it delivers. It may also be provided with means for automatically adjusting the power of the laser beam—in particular as a function of the production speed of the seam and/or the number of stitches produced.

Advantageously, according to the invention the machine includes at least one laser source adapted to soften the thermoplastic material without melting it by raising it locally to a temperature equal to or greater than its softening temperature but lower than its melting point, in particular to a temperature of 3° C. to 15° C. above the softening temperature. Advantageously, a machine according to the invention includes at least one nozzle forming at least one air jet directed on to the strands of stitching thread after the application of each laser beam and before the application of a pressing device. Advantageously, a machine according to the invention includes at least one nozzle forming an air jet having a width of the order of the diameter of the finest stitching thread carrying thermoplastic material, or smaller than this diameter Advantageously, according to the invention the machine includes at least one laser source adapted to be able to leave at least a part of the thickness of each strand of stitching thread in the un-softened state along its full length. Advantageously, according to the invention at least one laser source is adapted to be able to apply at least one laser beam in such a way as to soften only a part of the thickness of each strand of stitching thread to which it is applied.

Advantageously, a machine according to the invention is adapted, during one and the same passage of the sewn object across the stitching station, to be able to apply at least one laser beam after the formation of each stitch, and then to apply at least one pressing device to the softened thermoplastic material.

More particularly, the invention relates to a machine the stitching station of which includes at least one pair of transporting devices adapted to be able to press and pinch between them parts of the seam and the sewn object, and to transport the sewn object across the stitching station in a direction, called the stitching direction, as the seam is formed, these transporting devices being situated at least in part directly downstream of the stitching means, wherein at least one laser source is adapted to be able to apply at least one laser beam directly downstream of the stitching means to at least a part of the seam which is to be pinched and transported by the transporting devices, and immediately upstream of at least a part of the transporting devices which act as a pressing device or devices applied to the softened thermoplastic material of at least one strand of stitching thread while the seam is pinched.

Advantageously, according to the invention the machine includes at least one nozzle adapted to apply at least one air jet downstream of at least one laser beam and directly upstream of at least one corresponding part of the transporting devices performing the function of the pressing device or devices Advantageously, according to the invention at least one laser source is adapted to be able to apply at least one laser beam directly upstream of a transporting gripper of the stitching station which performs the function of a pressing device on the softened thermoplastic material. As a variant or in combination, the invention relates to a machine in which the stitching station includes a plate for receiving the sewn object, wherein the receiving plate includes at least a portion which is transparent to laser light and in that it includes at least one laser source adapted to be able to apply a light beam through this transparent portion of the receiving plate to the part of the seam which comes into contact with the receiving plate opposite said transparent portion. This transparent portion may be an aperture formed in the receiving plate or a portion of the receiving plate made of transparent material.

As a variant or in combination, according to the invention at least one laser source is advantageously adapted to apply at least one laser beam to a part of the seam which does not come into contact with the receiving plate—in particular to the face of the sewn object opposite the face of said object which comes into contact with the receiving plate. Adjacent strands extending on at least one of the exterior faces of the sewn object can therefore be integrated. One or more lines of linking points may be formed on each exterior face. In particular, two laser beams offset laterally may be used to form two parallel lines of linking points.

Advantageously, there are provided according to the invention means for adjusting the position of at least one laser beam with respect to the seam produced. In particular, in the case of a seam in the form of one or more lines of stitching, a machine according to the invention advantageously includes means for adjusting the point of impact on the seam of at least one laser beam along a direction perpendicular to the stitching direction and to the laser beam. In this way, the position of the point of impact of the laser beam, and therefore of the point of integration, may be laterally adjusted perpendicularly to the direction of stitching, for example as a function of the stitch formed and/or of the type of thread utilised.

Advantageously, a machine according to the invention is adapted to produce the seam using a stitch having threads which are interlooped, not interlaced. As a variant, it is adapted to produce the seam using a stitch having interlaced threads, the strands of adjacent threads being visible.

Advantageously, according to the invention the machine includes at least one pressing device at least a part of which designed to come into contact with said thermoplastic material is made of antiadhesive material.

The invention also relates to a method and a machine characterised in combination by all or some of the characteristics mentioned hereinabove or hereinbelow.

The invention therefore consists in joining together, on the exterior of the sewn object, adjacent strands of stitching thread(s) resulting from the production of the seam by means of the thermoplastic material of at least one of these adjacent strands. This is achieved by using, on the one hand, a laser beam to soften said thermoplastic material to a degree which allows it to act as a linking agent of the strands after cooling and, on the other, a pressing device which, when applied to this softened thermoplastic material, ensures contact of adjacent strands with this softened portion of thermoplastic material, and simultaneous cooling thereof. This results in a linking of adjacent strands by this thermoplastic material.

The adjacent strands may belong to the same stitching thread which, for example, is interlooped on one side of and on the exterior of the sewn object; or, conversely, to a plurality of distinct stitching threads. Preferably, the two adjacent strands both have thermoplastic material; as a variant only one strand may be formed by a thread having thermoplastic material, which comes into contact with the other strand after softening and through the effect of the pressing device. Each stitching thread having such thermoplastic material may be formed by such material or may be impregnated with that material, or may result from an association of fibres or threads prior to the production of the seam. This thermoplastic material is solid at room temperature. In the invention, therefore, no additional adhesive material is used to produce the bonding of strands which is obtained with the aid of a material forming part of at least one of the stitching threads.

The term "thermoplastic material" is therefore used to denote any material which is solid at room temperature but is susceptible to becoming softened when subjected to laser radiation of appropriate power. In particular, all synthetic materials belonging to the known category of thermoplastic polymers (polyolefins, polyesters, polyamides, etc.) may be used as thermoplastic material in a method according to the invention. These materials or other initially thermoplastic materials may be made more sensitive and reactive to laser radiation as indicated above by the addition of additives absorbent to laser radiation.

It is known that a laser beam can serve to heat a thermoplastic material punctually beyond its melting point, for example in order to cut threads of a fabric. Nevertheless, the inventor has observed that it is possible with a laser beam, by means of a very rapid initial adjustment of the power delivered, to precisely adjust the softening of the thermoplastic material to obtain the effect desired, that is, appropriate bonding of adjacent strands without fusion. In particular, it is possible not to melt adjacent strands nor to soften them throughout their thickness and therefore to preserve the functionality of these strands of the seam. This adjustment of the power of the laser beam is effected as a function of the type of thermoplastic material to be softened and the time of application of the laser beam which, in a machine with continuous transportation, depends on the speed of production of the seam. Moreover, a laser beam may be controlled instantaneously, continuously, in pulses or discontinuously. It may be interrupted at any moment, then re-used, in a very simple manner. It supplies heat with very high precision and with very high temperature regularity which is highly insensitive to changes in the external environment. It has been found in practice that adjustment of a laser to obtain partial fusion is extremely delicate, while that is not the case when only softening is sought. In that case the range of correct adjustment is indeed much wider.

It should also be noted that the invention is compatible with operation on an industrial scale, the consolidation of the seam by joining adjacent strands together being obtainable automatically, without handling, on the stitching station itself and in particular in a single stage corresponding to the seam-producing stage (i.e. without requiring a specific subsequent treatment stage even in the case of a back stitch).

Other objectives, characteristics and advantages of the invention are apparent from the following description of its preferred embodiments, given only as non-limiting examples and represented in the Figures, in which.

Figure 1:
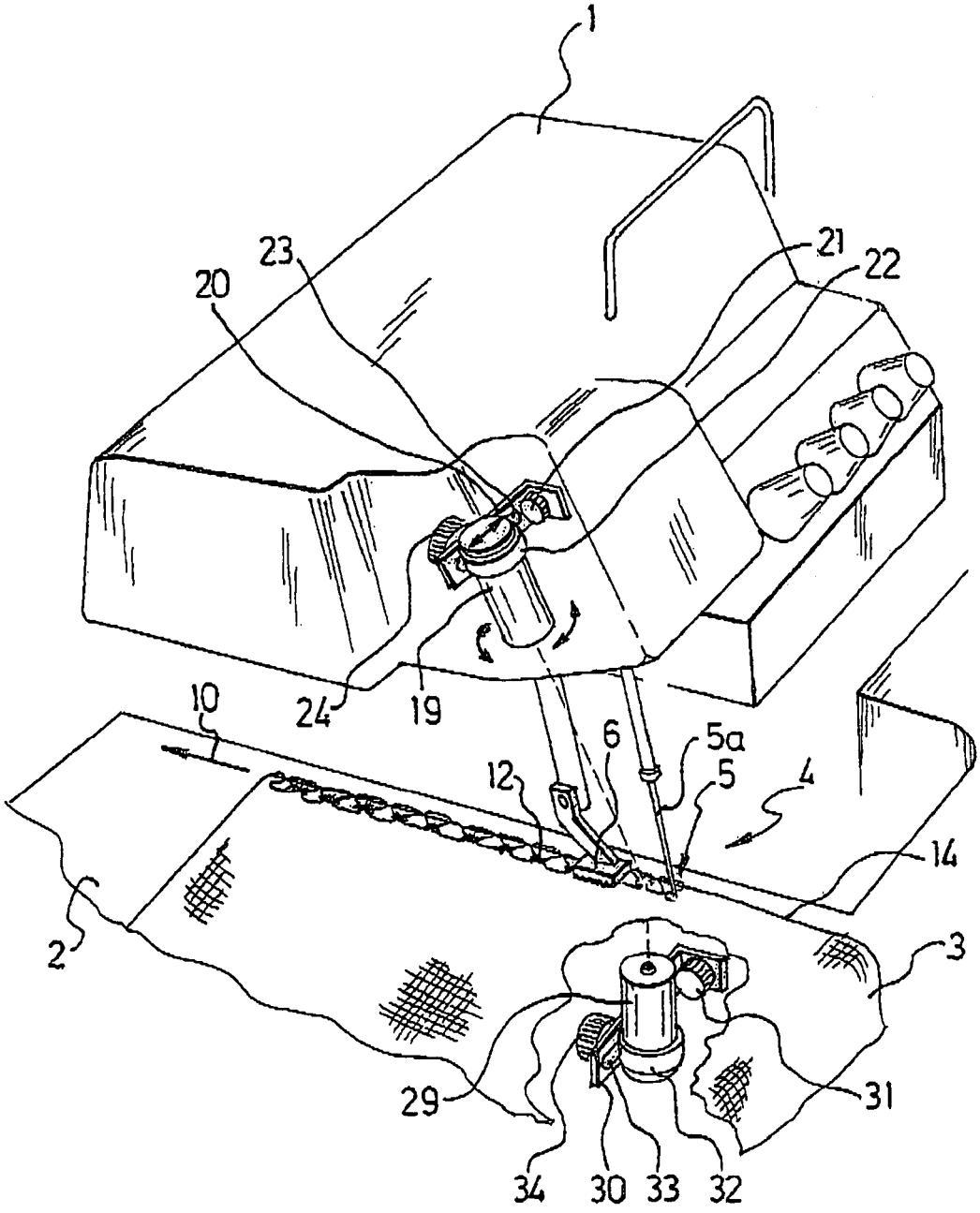
FIG. 1 is a schematic perspective view of an oversewing machine according to the invention.

FIG. 1 illustrates schematically an oversewing machine according to the invention comprising a supporting structure 1 carrying an appropriate mechanism and a plate 2 for receiving the sewn object 3 which, in the example illustrated, is a piece of fabric. The receiving plate 2 is at least substantially horizontal and flat.

The machine forms essentially a stitching station 4 provided with stitching means 5 comprising at least one needle 5*a* for stitching in or through at least one thickness of material of the sewn object 3. An oversewing machine conventionally also includes upper and lower looping hooks (not shown) which enable loops of thread to be formed above and below the piece of fabric and allow loops of stitching thread to be passed around the edge of the piece of fabric. In FIG. 1 not all the accessories and components of the oversewing machine are shown. In particular the thread bobbins, the looping hooks, etc. are not shown. In addition, the oversewing machine may, in a manner known per se, be equipped with numerous diverse accessories, for example a blade for cutting the edge of the piece of fabric, one or more pressing feet for engaging and holding the piece of fabric upstream of the needle 5, etc.

Figure 2:
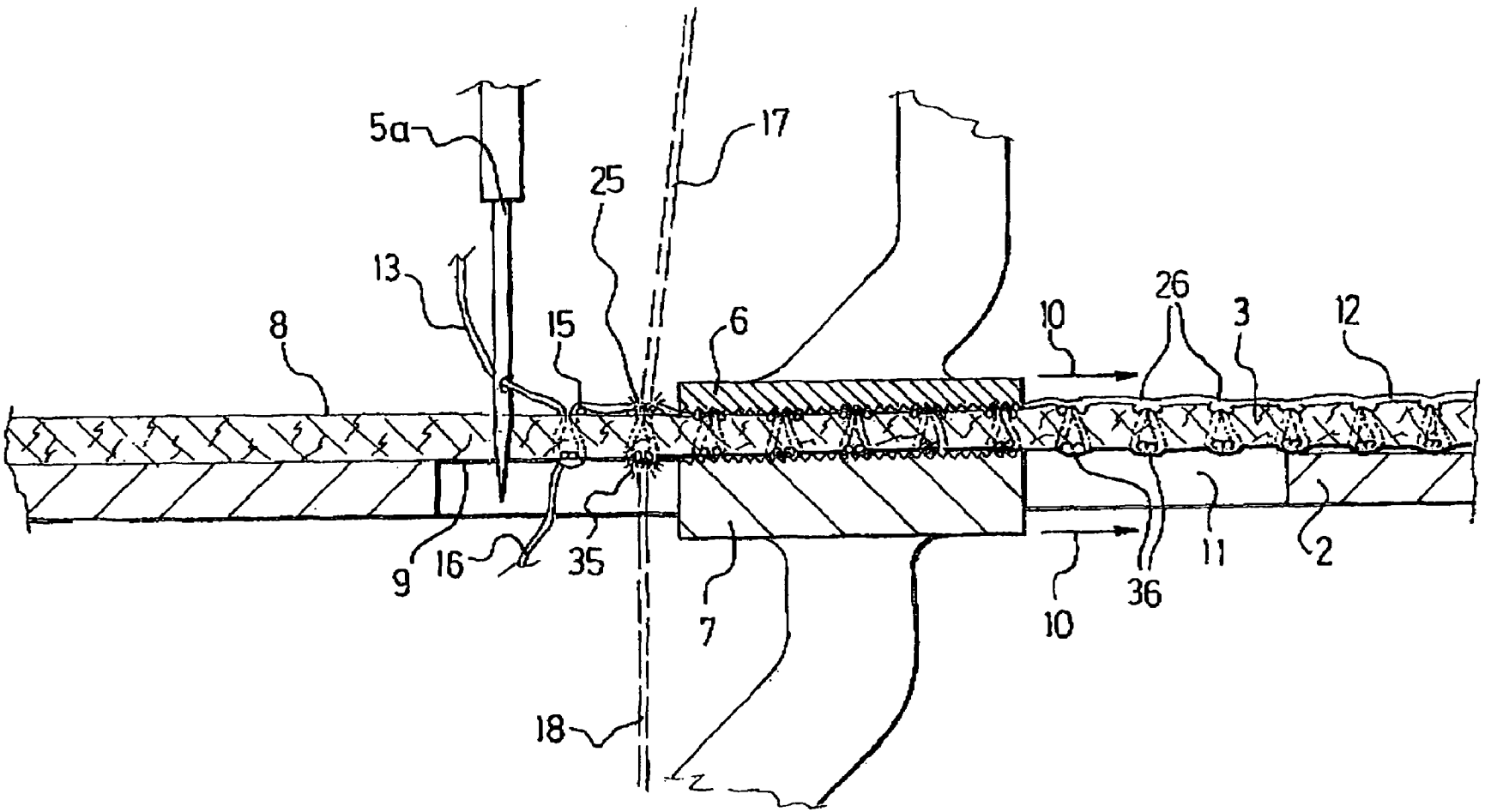
FIG. 2 is a schematic longitudinal vertical partial sectional view illustrating a method according to the invention implemented with the machine of FIG. 1.

As can be seen in FIG. 2, the oversewing machine includes, in the variant illustrated, two grippers 6, 7 for transporting the object 3, which are located immediately downstream of the needle 5*a* and, more generally, downstream of the stitching means 5. The upper transporting gripper 6 is applied to the upper exterior face 8 of the object 3 (the face opposite that which comes into contact with the receiving plate 2). This upper transporting gripper 6 is associated with a suitable mechanism and mounted with respect to the supporting structure 1 in such a way as to perform a repetitive longitudinal transporting movement in the stitching direction 10, then to be detached from the object 3 and returned upstream in a conventional manner well-known per se.

The lower transporting gripper 7 passes through at least one aperture 11 formed in the receiving plate 2 so as to come into contact with the lower exterior face 9 of the sewn object 3 (face 9 which comes into contact with the receiving plate 2). In this case too, the lower gripper 7 is transported repetitively in longitudinal movements from upstream to downstream in relation to the stitching direction 10, then detached from the object 3 and returned upstream in a successive manner. The movements of the two grippers 6, 7 are preferably synchronised and simultaneous so that these two grippers 6, 7 remain opposite one another and pinch between them the sewn object 3 and the formed seam 12. The grippers 6, 7 are located immediately downstream of the needle 5*a* with respect to the stitching direction 10, which corresponds to the direction of displacement of the sewn object 3 on the stitching station 4 of the machine.

Figure 3:
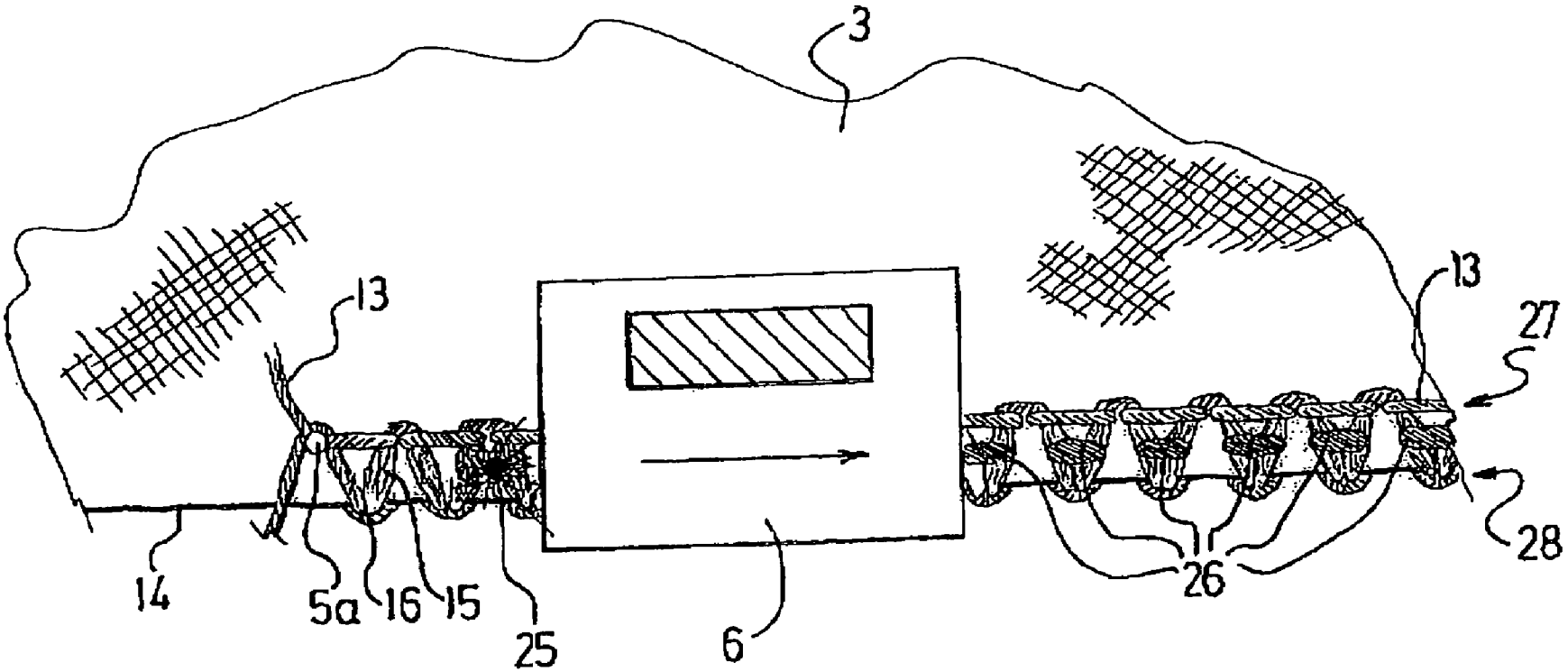
FIG. 3 is a schematic plan view of FIG. 2.

In the example illustrated in FIGS. 1 to 3 the seam 12 is formed by an overedge stitch comprising, for example, three threads including a needle thread 13 which forms a stitching line 27 across the material and parallel to the edge 14 of the sewn object 3, an upper looping thread 15 following a serpentine path on the upper face 8 of the object 3 and interlooped with the needle thread 13 at every stitch, and a lower looping thread 16 following a serpentine path on the lower face 9 of the sewn object 3, interlooped with the needle thread 13 at every stitch and also interlooped with the upper looping thread 15 outside the sewn object 3 along the edge 14, so as to form an external linking line 28 of these two looping threads 15, 16 around the edge 14 of the sewn object 3.

Such a stitch therefore forms adjacent strands of stitching thread on the upper exterior face 8 of the sewn object 3, and adjacent strands of stitching thread on the lower exterior face 9 of the sewn object 3. Likewise, the stitch has zones of interlacing of the stitching threads 13, 15 or 13, 16 or 15, 16 outside the sewn object 3.

The machine illustrated in FIGS. 1 and 2 has two laser beams 17, 18, i.e. an upper laser beam 17 and a lower laser beam 18. The upper laser beam 17 is emitted by an upper laser source 19 fixed to the supporting structure 1 of the machine by means of a bracket 20 fixed to the supporting structure 1 by a transverse horizontal screw 21, a collar 22 enclosing the body of the laser source 19 and passing through a slot 23 in the bracket 20 to be clamped by a screw 24. The slot 23 in the bracket 20 extends in a direction at least substantially perpendicular to the stitching direction 10. Thus, the bracket 20, the collar 22 and the screws 21, 24 form means of adjusting the relative position of the point of impact 25 of the laser beam 17 on the seam 12 with respect to said seam 12. The screw 21 allows the laser source 19 to pivot about a transverse horizontal axis globally perpendicular to the stitching direction 10. In this way the position of the point of impact 25 of the laser beams 17 may be adjusted longitudinally along the stitching direction 10 with the aid of this screw 21. The slot 23 allows the laser source 19 to be moved laterally, so that the laser beam 17 can be moved laterally with respect to the stitching direction 10. The screw 24 for clamping the collar also allows the laser source 19, and therefore the laser beam 17, to pivot about a pivot axis substantially parallel to the stitching direction 10, and therefore also allows the lateral position of the point of impact 25 of the laser beam 17 on the seam 12 to be adjusted.

According to the invention the position of the laser beam 17 is adjusted with the aid of these adjustment means in such a way that the point of impact 25 of this laser beam 17 on the seam 12 produced is situated immediately downstream of the needle 5*a* and upstream of the upper transporting gripper 6, as shown in FIG. 2. In this way, immediately after and downstream of the formation of the seam 12 by the stitching means 5 (including the needle 5*a*), the point of impact 25 of the upper laser 17 softens the thermoplastic material forming part of at least one of the stitching threads having adjacent strands resulting from this seam. In the example shown in FIG. 3 it is seen that the upper looping thread 15 forms adjacent strands winding between the stitching line 27 formed by the needle thread 13 and the outer edge 14 of the object 3. As the object 3 passes into the stitching station and is transported in the stitching direction, the upper laser beam 17 is applied to the different adjacent strands and softens the thermoplastic material forming part of this upper looping thread 15. Directly downstream of the point of impact 25, the upper gripper 6 is applied in a successive and repetitive manner to the seam 12 and therefore to the thermoplastic material of the upper looping thread 15 softened by the point of impact 25 of the laser beam 17. In doing so the gripper 6 presses on the softened thermoplastic material of the adjacent strands of the upper looping thread 15, which has the effect of joining these adjacent threads two-by-two by a portion of thermoplastic material to form bonding points 26 as represented schematically in FIG. 3. The upper transporting gripper 6 therefore forms a pressing device which is applied to the portions of softened thermoplastic material. This application also causes cooling and solidification of the thermoplastic material.

It should be noted that it is enough if at least one of the stitching threads has such thermoplastic material on its exterior, so as to be softened when the point of impact 25 of the laser beam 17 contacts this thermoplastic material. For this to take place, stitching threads of thermoplastic material, or threads associated previously with a thermoplastic material, may simply be used.

Instead of controlling the point of impact 25 of the laser beam 17 on the winding adjacent strands of the upper looping thread 15, it is also possible to control this point of impact 25 in such a way that it impinges on the stitching line 27 of the needle thread 13 and therefore on the zones of interlacing of this needle thread 13 with the upper looping thread 15. It is also possible to provide not only a single upper laser beam 17 but two distinct laser beams, one of which has a point of impact in the vicinity of the zones of interlacing of the needle thread 13 and the upper looping thread 15, while the other has a point of impact on the winding adjacent strands of the looping thread 15.

The machine represented in FIG. 1 also has a lower laser beam 18 which is similar to the upper laser beam 17 and is emitted by a lower laser source 29 fixed to the supporting structure 1 of the machine by means of a bracket 30, a transverse horizontal screw 31, a collar 32, a slot 33 formed in the bracket 30 and a screw 34 for clamping the collar 32, these different elements 30 to 34 being in all respects similar to the elements 20 to 24 which permit the mounting and adjustment of the upper laser source 19. Thus, the lower laser source 29 can also be positionally adjusted with respect to the supporting structure 1 so as to adjust the position of the point of impact 35 of the lower laser beam 18 on the seam 12 longitudinally with respect to the stitching direction 10 and laterally with respect to said stitching direction 10.

As shown in FIG. 2, the lower laser beam 18 passes through the aperture 11 formed in the receiving plate 2 in such a way as to come into contact with the seam 12 on the side of the lower exterior face 9 of the sewn object 3. The lower laser beam 18 has a point of impact 35 which is also situated downstream of the stitching means 5—in particular downstream of the needle 5*a*—and directly upstream of the lower gripper 7, which acts as a pressing device mixing the softened thermoplastic material of the different adjacent strands of stitching thread and cooling this thermoplastic material so as to re-solidify it to form bonding points 36. Here, too, it is possible to provide not only one lower laser beam 18 but a plurality of adjacent laser beams to form a plurality of parallel lines of lower bonding points. The two grippers 6, 7 are moved synchronously and exert pressing actions on the strands of thread, one against the other, the sewn object being trapped between them.

As thermoplastic material, any material may be used which is able to be softened sufficiently to form after cooling a relative bonding of the adjacent strands of stitching thread (strands of the needle thread interlaced with strands of a looping thread or adjacent strands of the same looping thread, or again, interlaced strands of two looping threads, etc). A polyamide or a polyolefin, for example a polyethylene or a polypropylene, or a polyester or a copolymer or a mixture of these materials may, for example, be used. For example, at least one stitching thread formed by a main core made of an aramide thread surrounded by 30 to 40% by weight of polypropylene fibres may be used.

This material may advantageously incorporate one or more additives such as pigments absorbent to laser radiation which facilitate softening. A stitching thread of non-thermoplastic material may also be impregnated with such thermoplastic material at the moment of stitching itself, by passing this thread through an impregnation device (liquid bath, contact with a pad, projection, etc.) of the thread carried by the machine.

Each laser beam 17, 18 is adapted to raise the thermoplastic material to a temperature, called the working temperature, above its softening temperature but markedly below its melting point, in particular to a working temperature which is 3° C. to 15° C.—in particular about 5° C.—above the softening temperature and at least 20° C. below the melting point.

The table below gives examples of working temperatures appropriate to different materials.

TABLE

| Material | High-tenacity polypropylene | Polyamide 6 | High-tenacity polyester | Polyamide 6.6 |
|---|---|---|---|---|
| Softening temperature | 120° C. | 170° C. | 220° C. | 230° C. |
| Melting point | 160° C. | 220° C. | 260° C. | 260° C. |
| Working temperature | 125° C. | 175° C. | 225° C. | 235° C. |

Advantageously, a floss and/or bulked stitching thread including fibres or strands of thermoplastic material, possibly mixed with other fibres or strands of non-thermoplastic material, is used. In this case, and contrary to what is shown in FIG. 3, the integration thus achieved is practically invisible, the softened thermoplastic material mingling with the different adjacent strands not in the form of a block or welding spot, but rather in the form of a multiplicity of micro-linking points of the different adjacent strands, as a result of the use of the gripper 6, 7 as the pressing device which, in practice, presses the softened thermoplastic material into a multiplicity of distinct points. Indeed, it is noted in practice that the use of floss stitching threads with a transporting gripper 6, 7 allows a bonding of strands to be formed which prevents subsequent unravelling of the seam without this bonding being actually visible to the naked eye or modifying the mechanical characteristics and properties of the seam 12 and the object 3.

It should also be noted that the points of impact 25, 35 of the lasers 17, 18 are located on the outer side of the stitching thread(s) and do not melt the thermoplastic material at the contact between the seam 12 and the sewn object 3 itself. As a result, the seam 12 is not welded to nor joined to the object 3. However, nothing prevents the orientation of the laser beams 17, 18 to be directed, if desired, so as to form a degree of incrustation between the seam 12 and the object 3. In general, however, such incrustation is not useful or even desirable.

As can be seen, it is sufficient to incorporate the sources 19, 29 forming the laser beams 17, 18 in the machine to obtain an extremely effective reinforcement of the seam 12 which does not subsequently come undone. This reinforcement does not in any way disturb the production of the seam 12 regarding its speed of execution. The seam 12 can even be produced with high-speed stitches regardless of the sewn object 3, which may be of any material (woven, knitted, leather, synthetic material, etc).

The laser sources 19, 29 used preferably have adjustable power and have power adapted to achieve the desired softening of the thermoplastic material. In practice an infrared laser may, for example, be used, for example $CO_2$ infrared laser diodes having a maximum power of 60 W, a wavelength of between 780 nm and 940 nm, a laser beam diameter of the order of 800 μm and low divergence. Such laser sources are commercially available, for example, from the COHERENT Company, Santa Clara, Calif., U.S.A. under the registered trade name FAP-SYSTEM®. A programmable automatic mechanism may be provided to automatically control the power of each laser beam 17, 18 according, in particular, to the speed of production of the seam 12 (operating speed of the machine) and/or the material of the stitching threads and/or the number of stitches produced per unit of length.

The laser sources 19, 29 of the machine are, of course, linked to a suitable electric power supply. It should be noted that instead of mounting the sources 19, 29 directly on the supporting structure 1 in an adjustable manner as described above, these sources 19, 29 may be mounted in a fixed manner at any other point on the supporting structure 1 of the machine and the laser sources 19, 29 may be connected to optical fibres or sheathed lenses the ends of which are mounted adjustably to the supporting structure 1 respectively above and below the seam 12, instead of the sources 19, 29 shown in FIG. 1. However that may be, it is the orientation and the position of the points of impact 25, 35 of the laser beams 17, 18 which it is necessary to be able to determine and adjust precisely.

Figure 4:
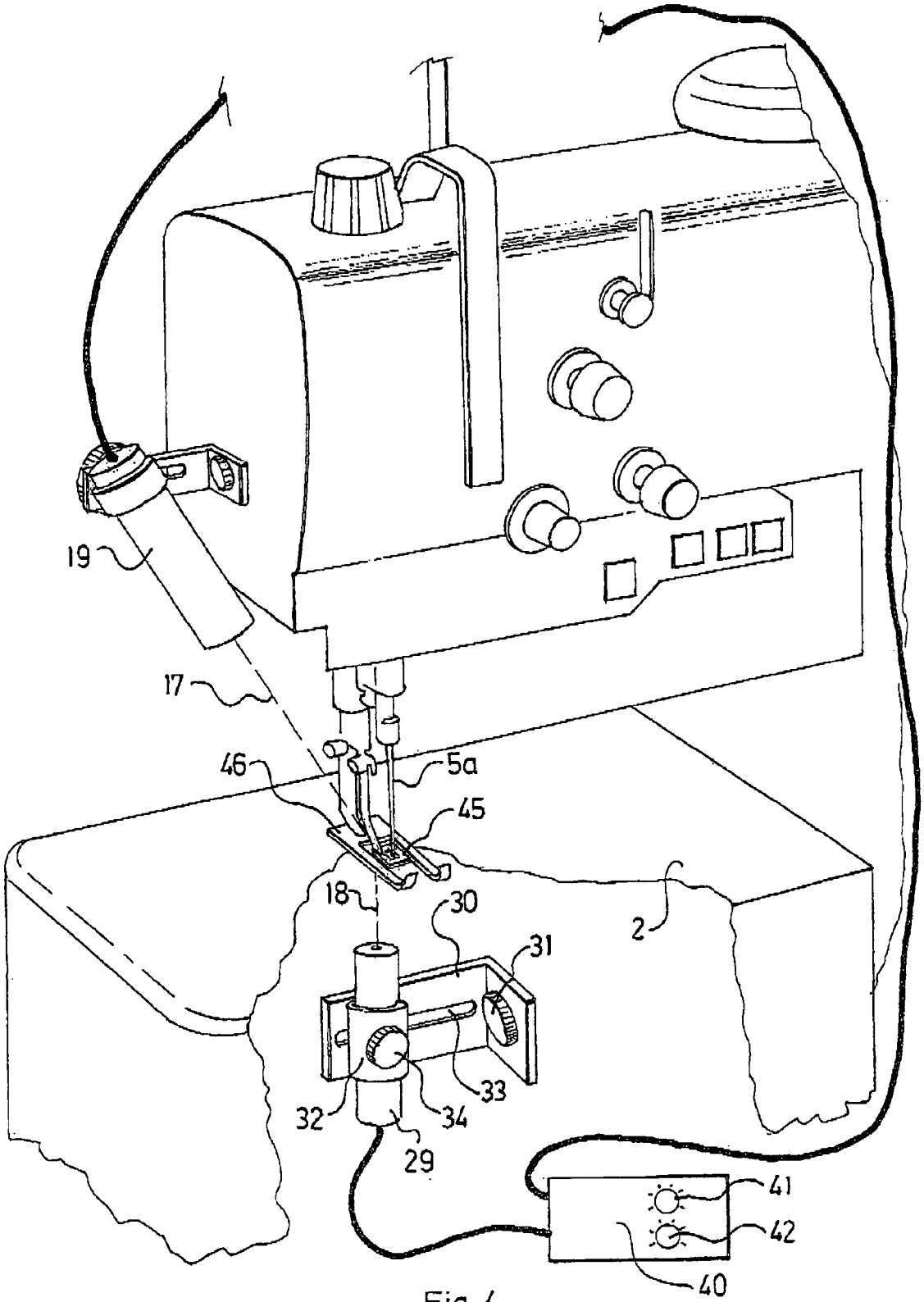
FIG. 4 is a schematic perspective view of a machine according to the invention for producing a lock stitch.

FIG. 4 represents another embodiment of a machine according to the invention more particularly adapted to produce a lock stitch. Here, too, two laser beams 17, 18 are provided, an upper laser beam 17 and a lower laser beam 18. The two laser sources 19, 29 are supplied by a common electrical supply 40 equipped with two separate control knobs 41, 42 for each of the two laser sources 19, 29 respectively.

In the variant shown in FIG. 4 the stitching means 5 comprise a stitching needle 5*a* and a bobbin 5*b* (not shown in FIG. 4). This machine includes a lower transporting gripper 7 and two upper transporting grippers 45, 46, i.e. the needle gripper 45 including an aperture 47 through which the needle 5*a* passes and which moves up and down and forwards and backwards simultaneously and synchronously with the needle 5*a*, parallel to the stitching direction 10. This needle gripper 45 is inserted between two front teeth of the main rear upper transporting gripper 46, in the form of a pressing foot which is also moved successively forwards and backwards parallel to the stitching direction 10 and up and down to transport the sewn object 3. Such a mechanism having two upper transporting grippers 45, 46, including a needle gripper 45, is known per se. The two transporting grippers 45, 46 are not in general transported synchronously and at the same speed because the needle gripper 45 follows the movements of the needle 5*a* which participates in the transporting of the sewn object 3, while the main rear upper transporting gripper 46 can have a greater longitudinal transporting amplitude. Such a transporting device allows in particular the production of a lock stitch having two threads, a needle thread 37 and a bobbin thread 38, the latter being supplied from a bobbin 5*b* rotating on a vertical axis, for example, and equipped with a hook for interlacing the threads 37, 38 at each stitch.

Figure 5:
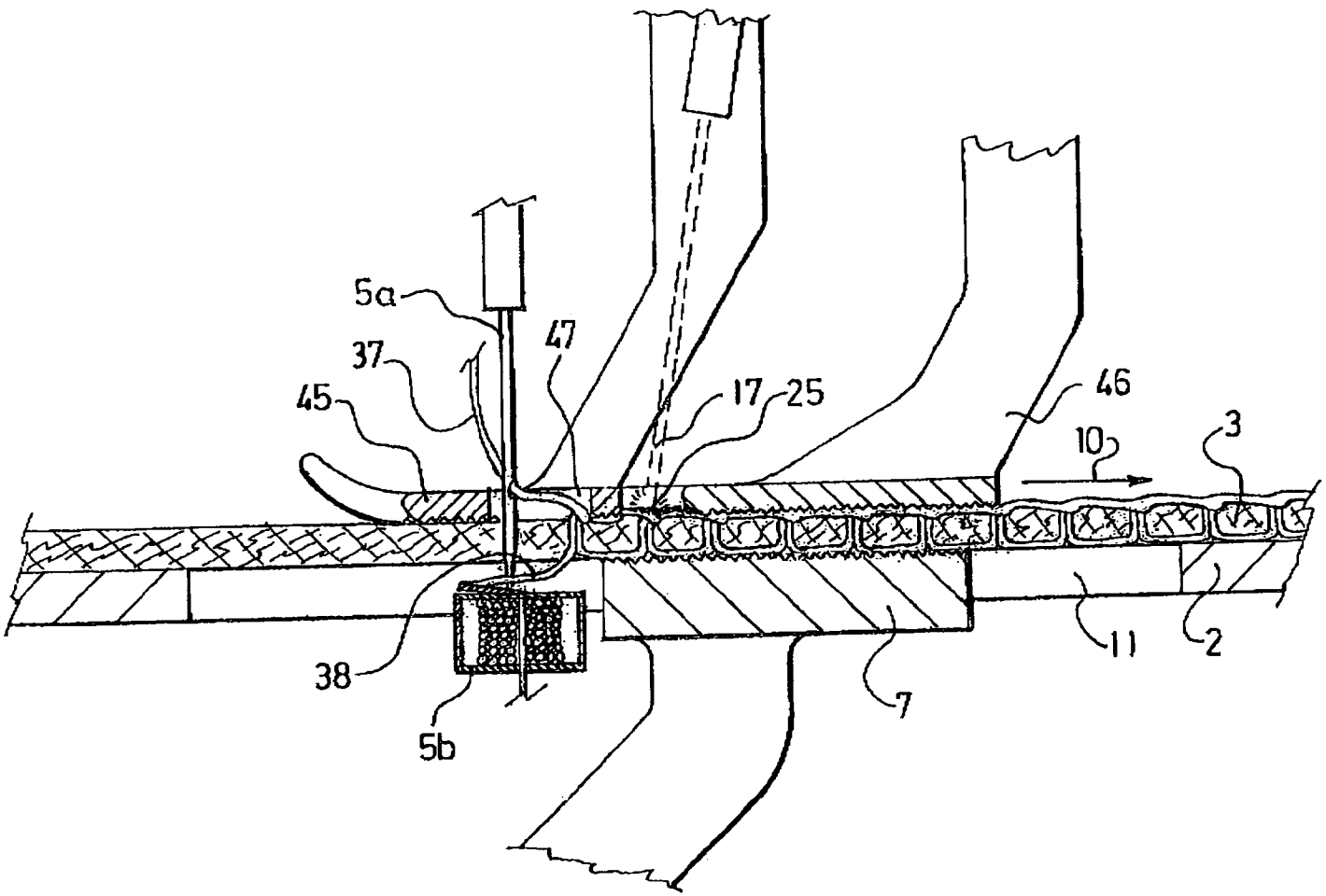
FIG. 5 is a schematic longitudinal vertical partial sectional view illustrating a method according to the invention with a lock stitch and an upper laser beam only.
Figure 6:
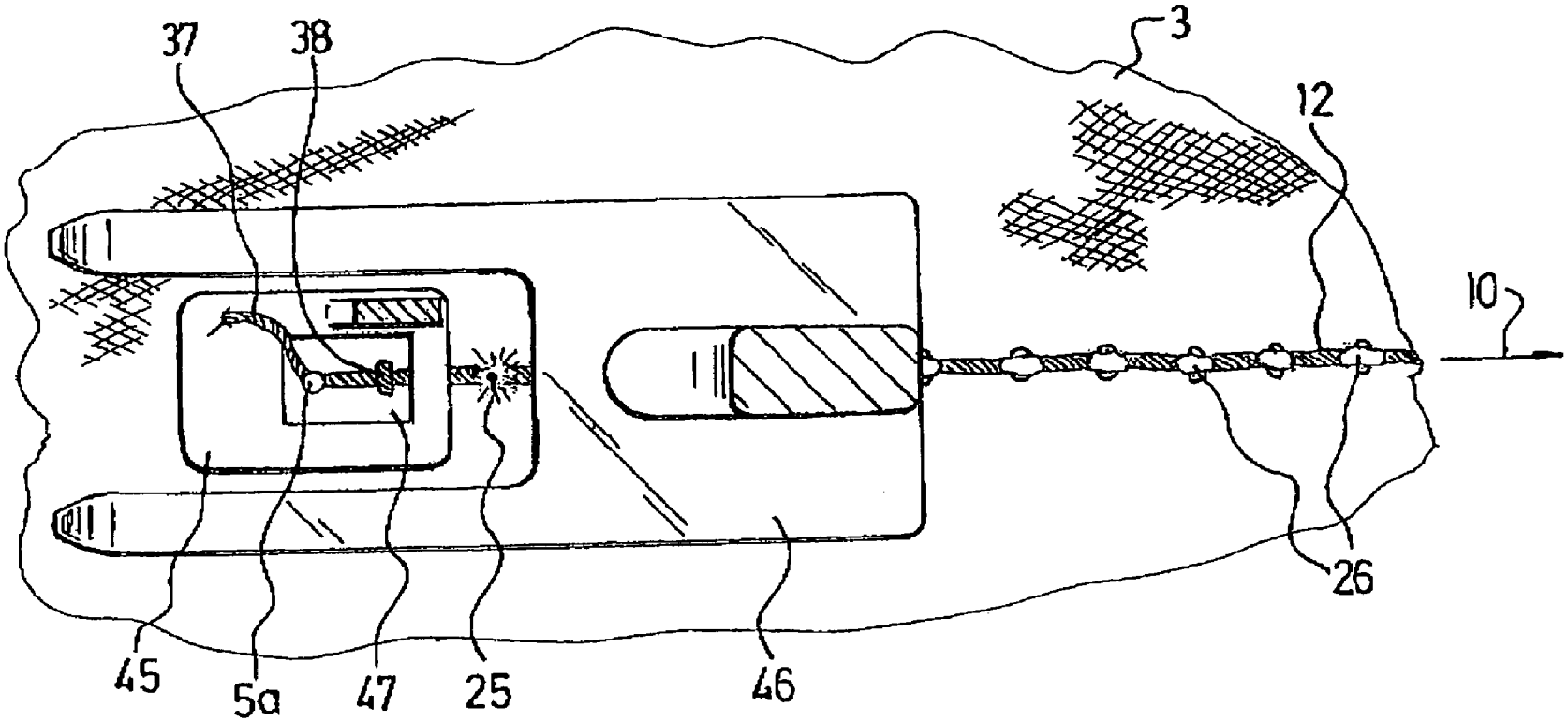
FIG. 6 is a schematic plan view of FIG. 5.
Figure 7:
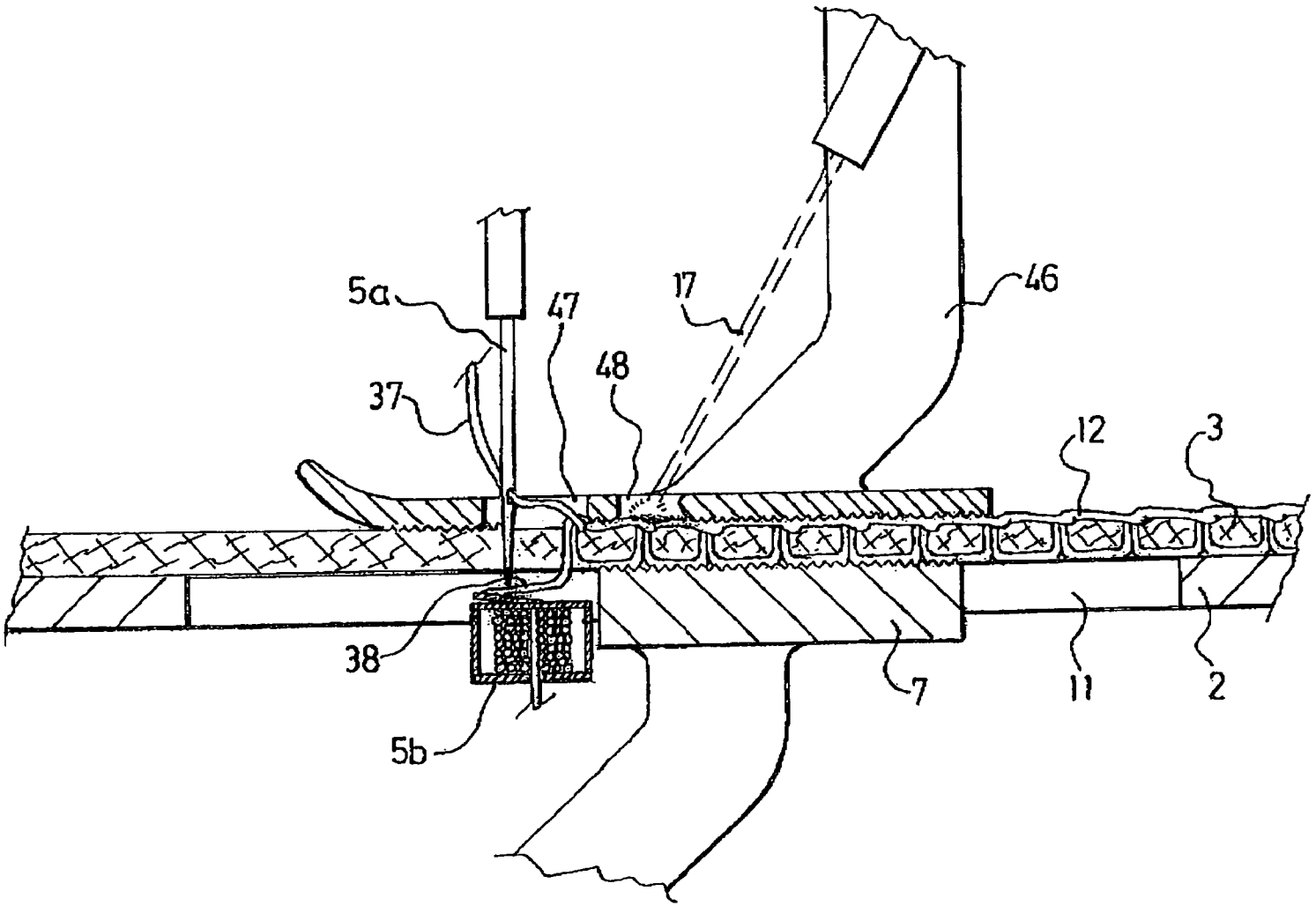
FIGS. 7 to 9 are views similar to FIG. 5 illustrating three other variants of the invention.
Figure 8:
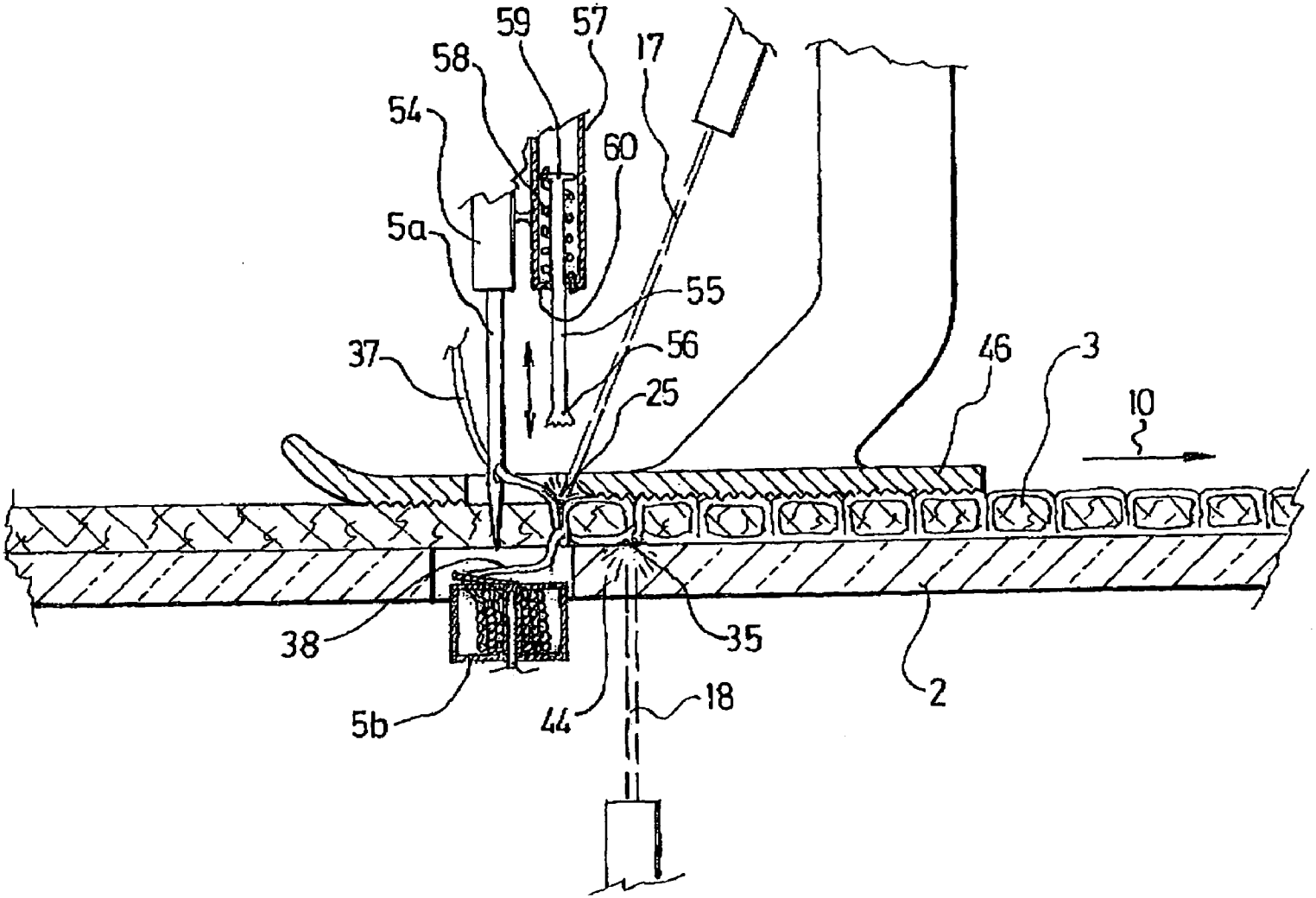

In the variant shown in FIGS. 5, 7 and 8 only the upper laser beam 17 is used, no lower laser beam being used. The tension of the needle thread 37 is preferably increased in relation to that of the bobbin thread 38 in order to cause the points of interlacing to emerge to the exterior, above the upper face 8 of the sewn object 3. In this way the point of impact 25 of the laser 17 softens the thermoplastic material of the needle thread and/or the bobbin thread in their zones of interlacement.

Advantageously, the upper laser beam 17 is positioned in such a way that the point of impact 25 is situated between the needle gripper 45 and the main rear gripper 46, i.e. downstream of the needle gripper 45 and upstream of said main gripper 46. In this way, it is the rear upper main gripper 46 which acts as the pressing device (unlike the lower gripper 7 and/or the receiving plate 2) for mingling the softened thermoplastic material and joining the strands together.

FIG. 7 shows a variant in which a lock stitch is obtained using a lower transporting gripper 7 and a single upper transporting gripper 46 which also forms a pressing foot. In this variant the upper gripper 46 is provided with an aperture 47 through which the needle 5*a* passes, and a second aperture 48 through which the upper laser beam 17 passes.

In the variant shown in FIG. 8 the needle 5*a* is carried by a needle carrier 54 on which is mounted a downwardly-extending rod 55 the lower end of which forms a pressing shoe 56. This rod 55 is guided in axial translational motions with respect to a support 57 which itself is rigidly locked in translation to the needle carrier 54. A tension spring 58 is interposed between the upper end 59 of the rod 55 and the lower end 60 of the support 57 so as to urge the stem 55 downwards. In this way the pressing shoe 56 moves in alternating vertical translational motions with the needle 5*a*. At the bottom position of the needle 5*a* the pressing shoe 56 comes into contact with the seam 12 to which it is applied with pressure by the spring 58 at the point where two adjacent strands of the needle thread 37 emerge vertically from the same stitch orifice in the upper face 8 of the object 3 formed by the needle 5*a* when forming the immediately preceding stitch. The upper laser beam 17 is oriented to form a point of impact 25, in particular on these two strands to soften them. The point of impact 25 of the upper laser beam 17 is slightly upstream—or at any rate extends upstream—of the point of contact of the pressing shoe 56 with the seam 12. The lower face of the pressing shoe 56 is preferably serrated or toothed in the form of a gripper or brush to better penetrate the softened material without flattening it. The pressing shoe 56 therefore brings about the bonding of these two strands, the outer portion of which is softened.

It should be noted that in a variant (not shown) such a pressing shoe may be actuated by a specific actuator programmed according to requirements. Its movements can then be made independent of those of the stitching elements 5, in particular the needle carrier 54.

Figure 9:
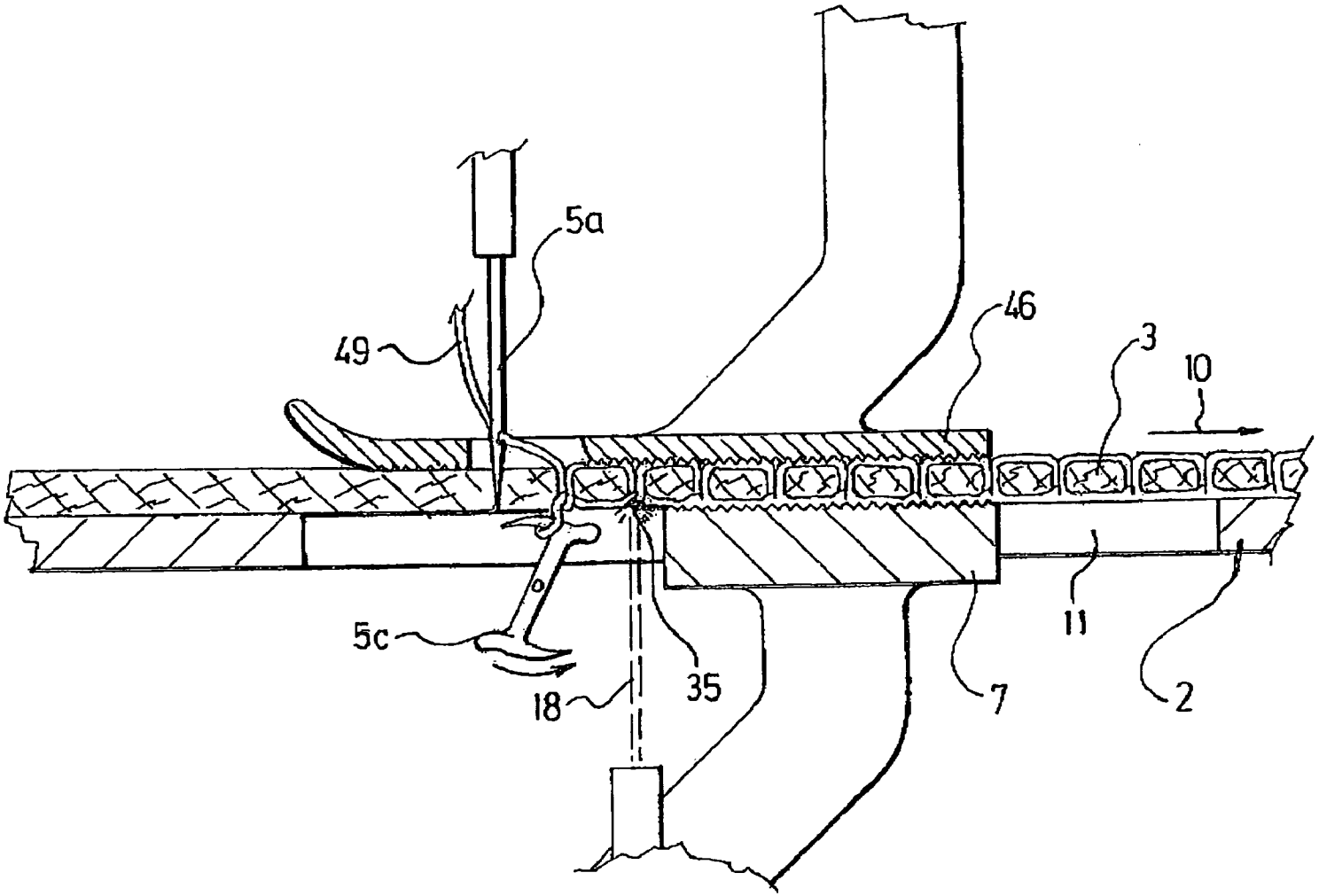
Figure 10:
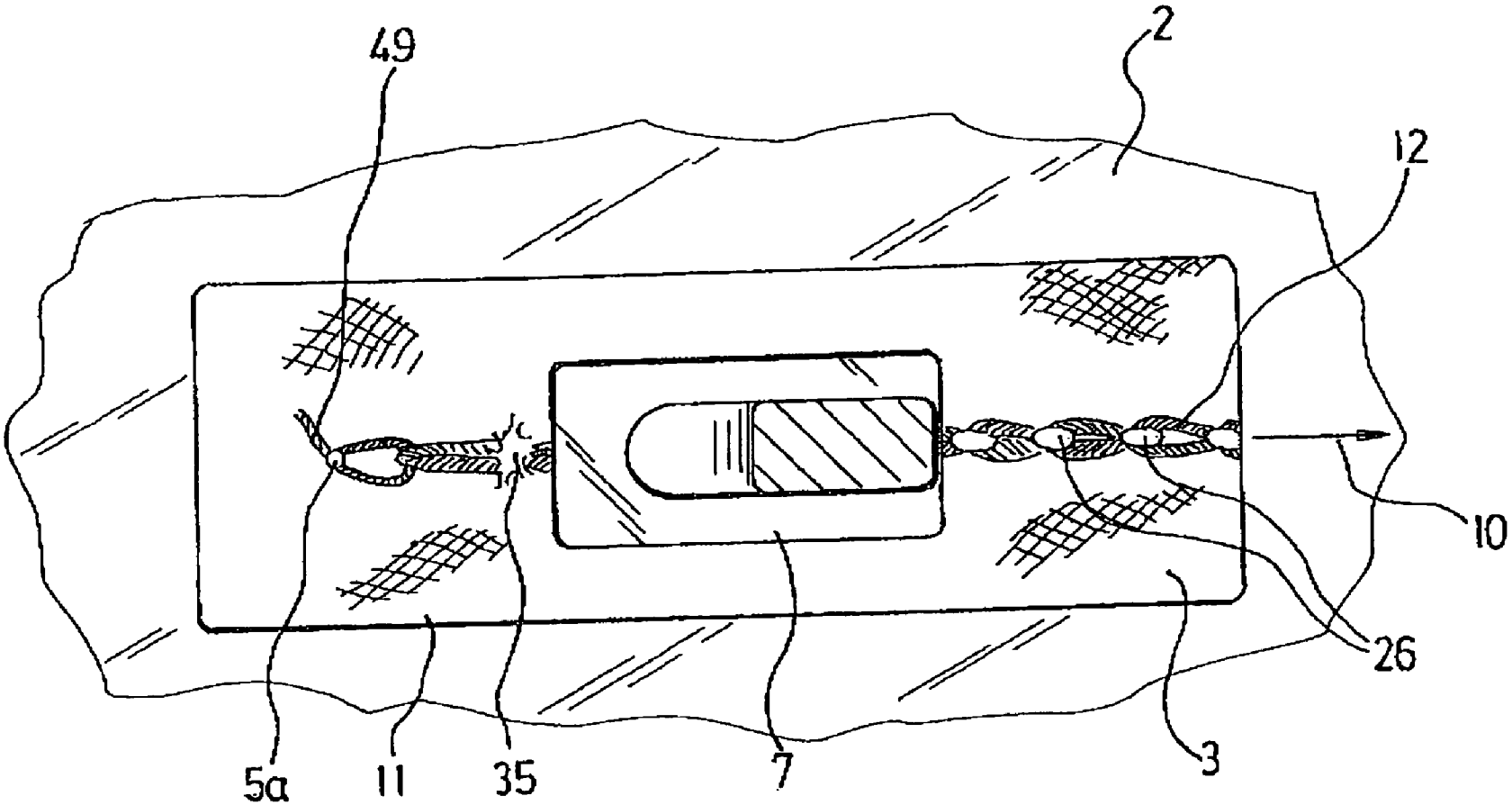
FIG. 10 is a schematic view from below of FIG. 9.

In the variant shown in FIGS. 9 and 10 a single lower laser beam 18 and no upper laser beam 17 is used. In addition, this variant represents the example of a single-thread chain stitch 49, with an upper transporting gripper 46 which forms a pressing foot having an aperture 45 through which the needle 5*a* passes and a lower transporting gripper 7 upstream of which the lower laser beam 18 forms a point of impact 35 on adjacent interlaced strands of stitching thread 49 forming the chain stitch. In the case of a chain stitch as shown in FIGS. 9 and 10 the linking by thermoplastic material occurs at the points of intersection of the different loops of interlooped stitching thread and/or between the parallel strands of these loops. The lower transporting gripper 7 acts as the pressing device, opposite the upper gripper 46, and forms bonding points 26 of the strands of thread 49 at their intersection where the thermoplastic material is softened by the laser beam 18. A double looping hook 5*c* rotating about a transverse horizontal axis is provided to form loops with the single stitching thread 49. In FIG. 10 the hook 5*c* is not shown.

Figure 11:
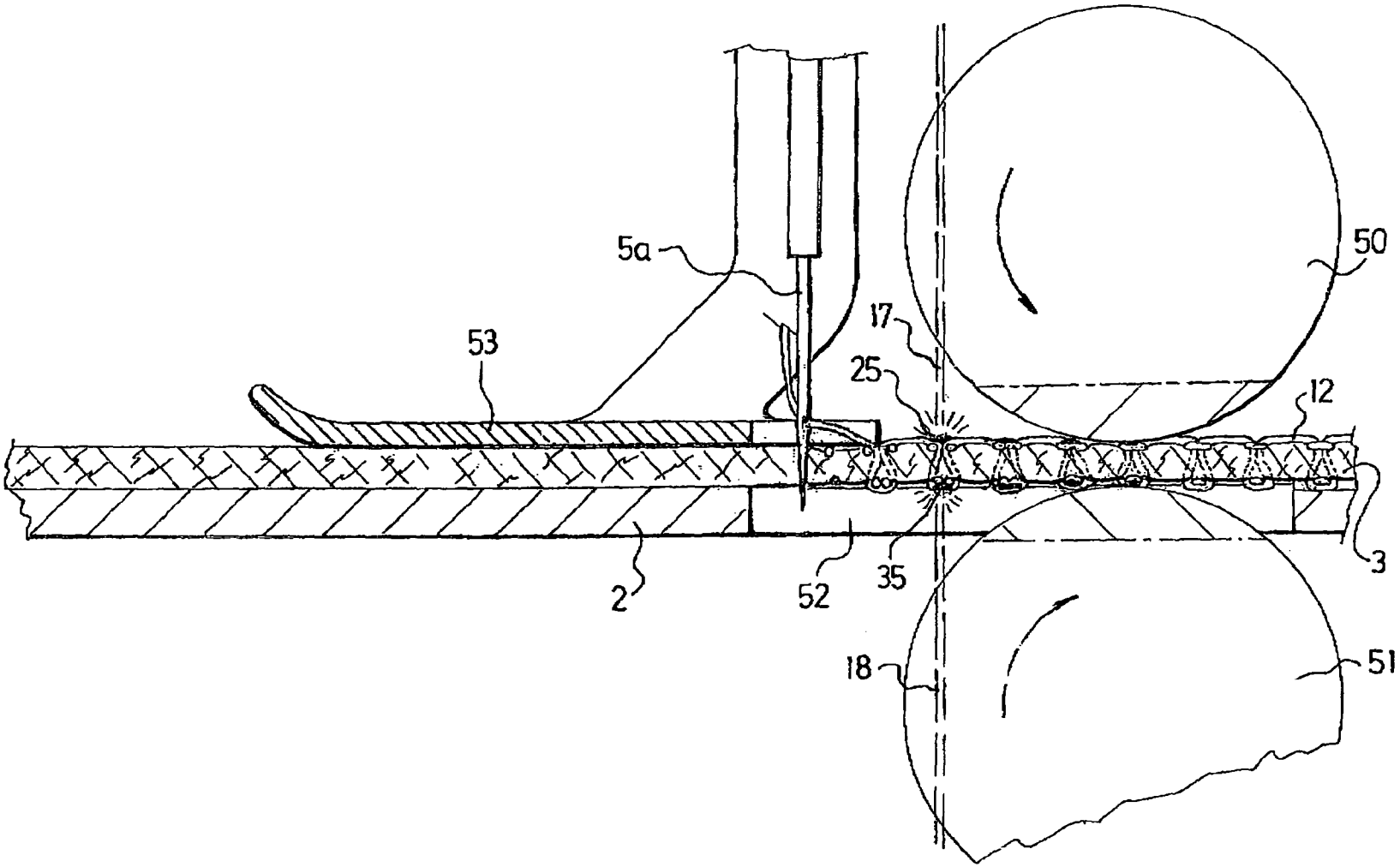
FIG. 11 is a view similar to FIG. 2 illustrating another variant of the invention in which the sewn object is transported by small wheels and not by grippers.
Figure 12:
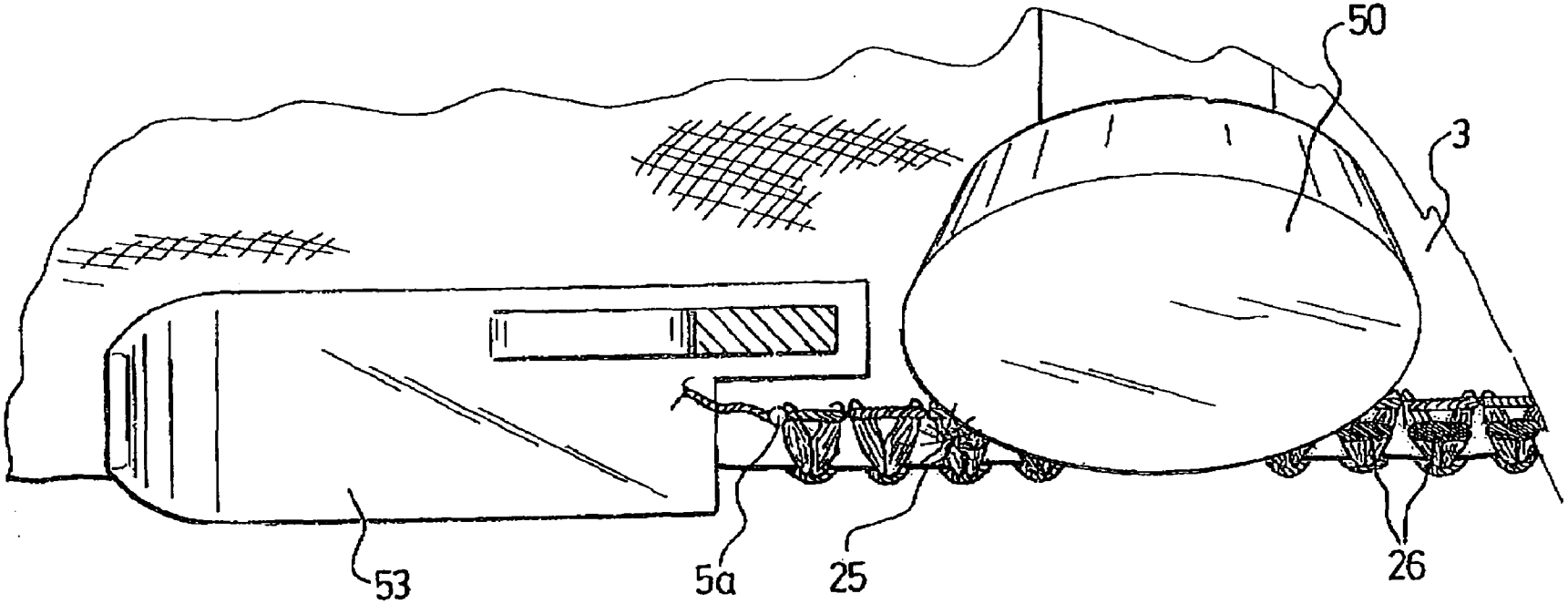
FIG. 12 is a schematic plan view of FIG. 11.

FIG. 11 shows another variant in which the sewn object 3 is transported in the stitching direction 10 not by means of transporting grippers but by a small upper wheel 50 and a small lower wheel 51. These two wheels 50, 51 are rotationally driven in such a way as to transport the sewn object 3 in the stitching direction 10. The lower wheel 51 passes through an aperture 52 formed in the receiving plate 2 to come into contact with the sewn object 3. As shown in FIG. 12, the axis of rotation of the upper wheel 50 and/or of the lower wheel 51 may be more or less inclined with respect to the horizontal, and the contact area between these wheels 50, 51 and the sewn object 3 and the seam 12 may have a serrated, corrugated, toothed or other irregular surface. In general, such transporting wheels 50, 51 are used for stitching fragile materials such as leather, which cannot withstand contact with grippers liable to be detrimental to their surface. In the example shown in FIG. 11 an upper laser beam 17 and a lower laser beam 18 have been provided directly downstream of the needle 5*a*, which itself is downstream of a pressing foot 53. The example of an overedge stitch is illustrated.

Also illustrated in FIGS. 11 and 12 are air jets 70, 71, an upper air jet 70 issuing from an upper nozzle 72 fed with pressurised air by an upper tube 74, and a lower air jet 71 issuing from a lower nozzle 73 fed with pressurised air by a lower tube 75. These air jets 70, 71 are applied to the adjacent strands of thread directly upstream of the pressing elements (wheels 50, 51 in this variant) so as to disperse the fibres of softened thermoplastic material before they are pressed by the pressing devices 50, 51 to bond the adjacent strands. These air jets 70, 71 are downstream of the points of impact of the lasers 17, 18. They are very fine in order to effect a correct dispersion of the fibres and not to supply an excessive delivery of air which would cool the thermoplastic material to the point of re-solidification. If required, the air used may be heated so that the thermoplastic material remains well softened on contact with the pressing elements 50, 51.

These air jets 70, 71 or other air jets may be provided on the machine to cool certain parts of the machine which would be heated up—for example, metal parts facing the laser beams 17, 18—in the absence of the object to be sewn; and/or to clean the outlets of the laser sources 19, 29 (outlets of diodes or ends of optical fibres, etc.) through which the beams 17, 18 are emitted and which would become clogged. Although illustrated only for the variant in FIGS. 11 and 12, such air jets 70, 71 may be used in all the embodiments described hereinabove or hereinafter. The air jets 70, 71 are supplied with air at a pressure of the order of $3 \cdot 10^5$ Pa or above and the nozzles 72, 73 have a very fine diameter of the order of the diameter of the stitching thread(s) which include thermoplastic material, or smaller than this diameter. The nozzles 72, 73 are placed in direct proximity (as close as possible) to the strands of stitching thread 12, to be able to disperse the fibres of the thread to which the corresponding air jet is applied.

The pressing device(s) may be made of different rigid materials (metals, synthetic materials, etc.). Advantageously, an antiadhesive material belonging, for example, to the group of fluorocarbon polymers, in particular PTFE or TEFLON®, to which the softened thermoplastic material does not become attached during stitching, is used at least for the part of the pressing device(s) which come into contact with the softened thermoplastic material, thus avoiding the depositing of residues and the development of harmful friction. This solution is advantageous in particular for multicoloured decorative seams in relief in which it also avoids mixing of colours.

At the end of the seam it is possible to form one or more back stitches (by reversing the transporting direction of the object by the machine). This or these back stitch(es) is/are also consolidated by the thermoplastic material which integrates their adjacent strands.

Figure 13:
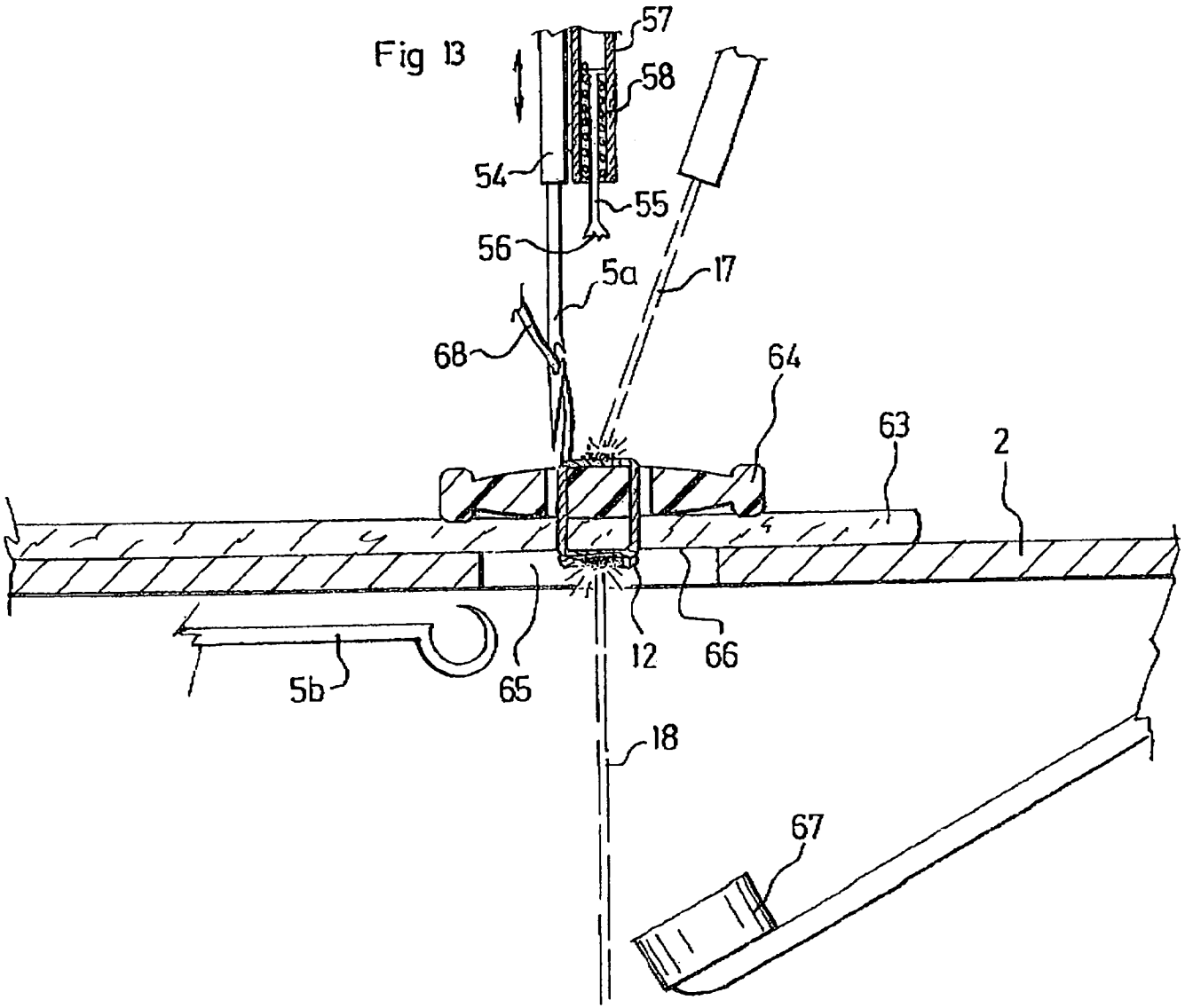
FIG. 13 is a schematic vertical sectional view illustrating a stitching station for a machine according to the invention for attaching a button using a method according to the invention while stitching.
Figure 14:
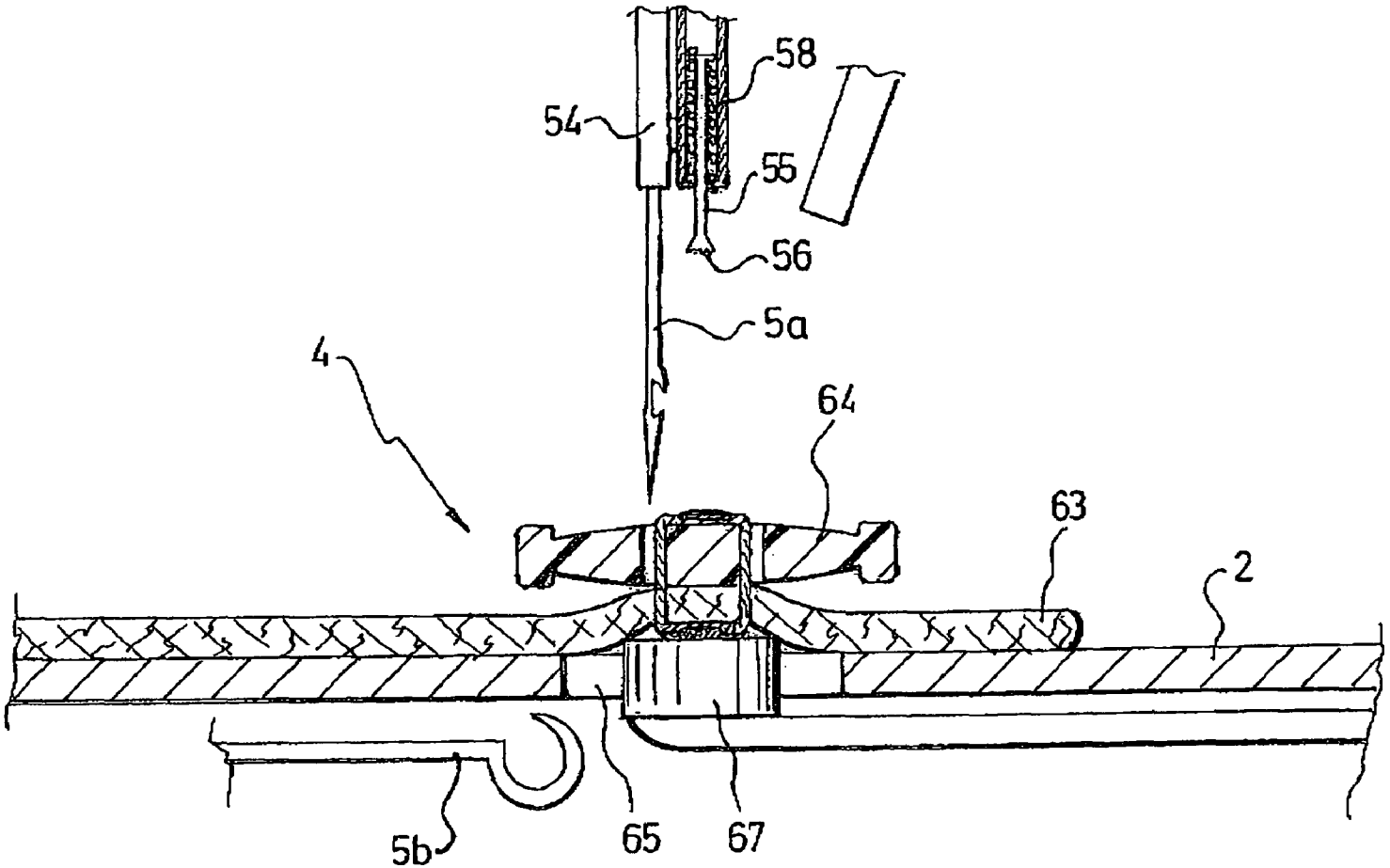
FIG. 14 is a view similar to FIG. 13 illustrating a stage of applying an ejector pressing device after production of the seam, in a process according to the invention.

In the variant in FIGS. 13 and 14 the stitching station of the machine is not of the transporting type; that is, the sewn object 63 is not moved across the stitching station. In the example illustrated this sewn object is formed by a thickness of fabric 63 and a button 64 which are sewn together by button-stitching means well known per se, but using a stitching thread 68 having thermoplastic material at least on its exterior. The stitching means comprise in general a needle 5*a* and a hook 5*b*. The receiving plate 2 has an aperture 65 for the needle 5*a* to pass through. A lower laser beam 18 may be directed on to the stitching formed, towards the lower outer face 66 of the fabric 63, so as to soften the thermoplastic material of the stitching thread 68 as this stitching is formed. It should be noted that the stitching forms adjacent strands of stitching thread 68 which are successively softened by the laser beam 18 and which cross over one another as the stitching is formed. By this means alone these different strands are joined together in the course of stitching. In addition, an ejector device 67 may be provided which is movable so as to pass through the aperture 65 to come into contact with the lower portion of the stitching after the ending of the latter. This ejector device 67 which, when applied to different strands of softened stitching thread 68 adjacent to one another, acts as the pressing device, has an irregular, for example toothed, contact surface and thereby joins these strands together. Any subsequent unravelling is thereby avoided. Thus, even in case of breakage of one of the loops of stitching thread 68 formed through the button, the other loops are still held and the thread does not unravel. FIG. 14 shows the ejection position in which the ejector device 67 comes into contact with the stitching formed, thereby bonding the strands. The face of the ejector device 67 which comes into contact with the softened strands of stitching thread 68 is not smooth but on the contrary has the form of a gripper in order to produce a plurality of micro-bonding points in the strands of the thread 68.

Also shown in FIGS. 13 and 14 is an upper laser beam 17 able to soften the strands of the stitching thread above the button 64. The needle carrier 54 also has a rod 55 forming a pressing shoe 56 which is applied with pressure, through the intermediary of a spring 58 to the softened strands of thread 68 to bond them as the stitching is formed, as in the variant in FIG. 8. Here, too, the ejector device 67 and/or the pressing shoe 56 may be made of antiadhesive material.

The machine according to the invention may be equipped with safety devices or automatic safety controls (not shown). For example, an automatic control can interrupt (by means of a presence-detecting photoelectric cell) the operation of the laser sources 19, 29 if no object 3 to be sewn is in position on the work-carrying plate 2 and/or if the vertically movable pressing foot 46, 53 for moving an object 3 to be sewn into position is in its upper position. In this way application of the laser beams 17, 18 to metal parts of the machine is avoided. Likewise, a casing made of transparent material which filters laser radiation and surrounds the stitching station 4 is advantageously provided to protect the user by avoiding any parasitic reflection towards the user.

The invention may be the subject of very numerous variants other than those described above and represented in the Figures solely by way of non-limiting examples. In particular, it may be applied to other types of stitches and stitches using a different number of threads. Furthermore, the different variants may in part be combined among themselves.

The invention claimed is:

1. A method for producing a bonded seam which is not susceptible to coming undone, with at least one of an interlooped and interlaced stitching thread and with stitching passing into at least one thickness of the material of a sewn object which receives the seam, this seam comprising at least one strand of sewn stitching thread extending on the exterior of the sewn object and extending adjacent to at least one other strand of sewn stitching thread on the exterior of the sewn object, comprising the sequential steps of:

producing an unbonded seam using at least one stitching thread having an exterior of thermoplastic material, the thermoplastic material having a softening temperature and a melting point temperature;

applying at least one laser beam on the unbonded seam at a local point of the thermoplastic material exterior of at least one strand of sewn stitching thread extending on the exterior of the sewn object adjacent to at least one other strand of sewn stitching thread on the exterior of the sewn object, each laser beam adapted to locally raise a temperature of the thermoplastic material, at the local point, equal to at least the softening temperature but below the melting point temperature to soften the thermoplastic material of the at least one strand of sewn stitching thread adjacent to the at least one other strand of sewn stitching thread, the laser beam being applied without melting any thermoplastic material; and before complete re-solidification of the softened thermoplastic material, applying at least one pressing device to the softened thermoplastic material of the at least one strand of stitching thread to form bonding points of the softened thermoplastic material bonding together at least some of the adjacent strands on the exterior of the sewn object.

2. Method as claimed in claim 1, wherein at least one laser beam is adapted to raise the thermoplastic material locally to a temperature of 3° C. to 15° C. above the softening temperature.

3. Method as claimed in claim 1, wherein at least one jet of pressurized air is applied to the strands of stitching thread after the application of each laser beam and before the application of a pressing device.

4. Method as claimed in claim 3, wherein the air jet has a width of an order of a diameter of a finest stitching thread which includes the thermoplastic material.

5. Method as claimed in claim 1, wherein at least one stitching thread formed by at least one thermoplastic material is used, and at least one laser beam so adapted that at least a part of the thickness of each strand of said stitching thread of thermoplastic material softened by said laser beam remains in an un-softened state along its full length.

6. Method as claimed in claim 1, wherein at least one laser beam is applied in such a way as to soften only a part of the thickness of each strand of stitching thread to which the laser beam is applied.

7. Method as claimed in claim 1, wherein the seam is produced by passing the sewn object over a stitching station of a sewing machine and, during one and the same passage of the sewn object over this stitching station, at least one laser beam is applied after the production of each stitch, and then at least one pressing device is applied to the softened thermoplastic material.

8. Method as claimed in claim 7, wherein, the stitching station comprising:

stitching means including at least one stitching needle, at least one pair of transporting devices between which parts of the seam and of the sewn object are pressed and pinched and which are able to transport the sewn object as the seam is produced in a direction, called the stitching direction, across the stitching station, said transporting devices being at least in part situated directly downstream of the stitching means, at least one laser beam is applied directly downstream of the stitching means to at least a part of the seam which is to be pinched and transported by the transporting devices, and directly upstream of at least a part of the transporting devices which, as the seam is pinched, act(s) as the pressing device(s) applied to the softened thermoplastic material of at least one strand of the thread of the seam.

9. Method as claimed in claim 8, wherein at least one laser beam is applied directly upstream of a transporting gripper of the stitching station which acts as the pressing device on the softened thermoplastic material.

10. Method as claimed in claim 9, wherein, at least one jet of pressurised air is applied to the strands of stitching thread after the application of each laser beam and before the application of a pressing device, and at least one air jet is applied downstream of at least one laser beam and directly upstream of at least a corresponding part of the transporting devices acting as pressing device(s).

11. Method as claimed in claim 1, wherein the seam is produced with at least one floss and/or bulked stitching thread.

12. Method as claimed in claim 1, wherein the seam is produced using a stitch having threads which are interlooped and not interlaced.

13. A method for producing a bonded seam, comprising the steps of:

from a needle location, forming an external linking line (28) by stitching a needle thread (13) forming a stitching line (27) across a material of a sewn object, an upper looping thread (15) following a serpentine path on an upper exterior face (8) of the sewn object and interlooped with the needle thread, and a lower looping thread (16) following a serpentine path on a lower exterior face (9) of the sewn object (3), interlooped with the needle thread (13) and also interlooped with the upper looping thread (15) outside the sewn object (3) to form the external linking line (28) of the upper and lower looping threads with adjacent strands of the needle thread on the upper exterior face of the sewn object, at least two threads of the needle thread and the upper and lower looping threads having an exterior of thermoplastic material, the thermoplastic material having a softening temperature and a melting point temperature;

with a laser beam (17) positioned downstream of the needle location and upstream of a pressing device, locally applying the laser beam at a point of laser beam impact on the thermoplastic material of at least one of the two threads to locally softening the thermoplastic material of the one thread by locally raising a temperature of the thermoplastic material of the one thread, at the point of impact, to at least the softening temperature but below the melting point temperature, said applying of the laser beam being controlled to avoid any melting of any thermoplastic material; and after the application of the laser beam and before the complete re-solidification of the softened thermoplastic material, using the pressing device against the softened thermoplastic material of the one thread to join the two threads together at bonding points (26).

14. Method as claimed in claim 13, wherein the laser beam is controlled to raise the thermoplastic material locally to a temperature of 3° C. to 15° C. above the softening temperature.

15. A method for producing a bonded seam, comprising the sequential steps of:

forming an external unbonded seam of two adjacent threads, one of the two threads having an exterior of thermoplastic material, the thermoplastic material having a softening temperature and a melting point temperature;

subjecting the thermoplastic material of the unbonded seam to a laser beam to locally raise a temperature of the thermoplastic material to at least the softening temperature and below the melting point temperature; and after the locally softening the thermoplastic material with the laser beam and before the complete re-solidification of the softened thermoplastic material, using a pressing device against the softened thermoplastic material to have the softened thermoplastic material form bonding points joining the two adjacent threads together, wherein use of the laser is controlled to be free of melting any thermoplastic material.

16. Method as claimed in claim 15, wherein the laser beam is controlled to raise the thermoplastic material locally to a temperature of 3° C. to 15° C. above the softening temperature.

* * * * *